US006716776B2

(12) United States Patent
Morishima et al.

(10) Patent No.: US 6,716,776 B2
(45) Date of Patent: Apr. 6, 2004

(54) NONWOVEN FABRIC MADE FROM FILAMENTS AND ARTIFICIAL LEATHER CONTAINING IT

(75) Inventors: Kazuhiro Morishima, Matsuyama (JP); Yasuo Yamamura, Matsuyama (JP); Mikio Tashiro, Matsuyama (JP); Hiroshi Honna, Ibaraki (JP); Makoto Yoshida, Ibaraki (JP); Michikage Matsui, Ibaraki (JP); Nobuo Okawa, Mihara (JP); Satoshi Maeda, Mihara (JP); Hideki Nitta, Mihara (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 09/877,195

(22) Filed: Jun. 11, 2001

(65) Prior Publication Data

US 2001/0038901 A1 Nov. 8, 2001

Related U.S. Application Data

(62) Division of application No. 09/310,976, filed on May 13, 1999.

(51) Int. Cl.[7] ..... B32B 27/04; B32B 27/12; D04H 3/00

(52) U.S. Cl. ..... 442/104; 442/340; 442/341; 442/347; 442/351; 442/363; 428/904

(58) Field of Search ..... 442/340, 347, 442/351, 363, 341, 104; 428/904

(56) References Cited

U.S. PATENT DOCUMENTS

| | | | | |
|---|---|---|---|---|
| 3,731,352 A | | 5/1973 | Okamoto et al. | |
| 4,008,344 A | * | 2/1977 | Okamoto et al. | 264/172.13 |
| 4,107,374 A | | 8/1978 | Kusunose et al. | |
| 4,620,852 A | | 11/1986 | Nishikawa et al. | |
| 4,735,849 A | | 4/1988 | Murakami et al. | |

FOREIGN PATENT DOCUMENTS

| | | |
|---|---|---|
| EP | 855 461 | 7/1998 |
| GB | 2 085 043 | 4/1982 |
| JP | 03 294585 | 12/1991 |
| WO | WO99/11853 | 3/1999 |

* cited by examiner

*Primary Examiner*—Cheryl A. Juska
*Assistant Examiner*—Jenna-Leigh Befumo
(74) *Attorney, Agent, or Firm*—Sughrue Mion, PLLC

(57) ABSTRACT

A nonwoven fabric made of filaments, which comprises filaments formed from a fiber-forming thermoplastic polymer and satisfies all of the following conditions (A) to (D).

(A) The fiber bundles are present in a range of 5–70 per centimeter in any cross-section parallel to the direction of thickness of the nonwoven fabric.

(B) The total area occupied by the fiber bundles is in a range of 5–70% of the cross-sectional area of any cross-section perpendicular to the direction of thickness of the nonwoven fabric.

(C) The apparent density is 0.10–0.50 g/cm$^3$.

(D) The cut ends of the fibers on the nonwoven fabric surface are present in a range of 5–100 per mm$^2$ of surface area.

1 Claim, 8 Drawing Sheets

NONWOVEN FABRIC MADE FROM FILAMENTS AND ARTIFICIAL LEATHER CONTAINING IT

This is a divisional of application Ser. No. 09/310,976, filed May 13, 1999, the disclosure of which is incorporated herein by reference.

BACKGROUND OF THE INVENTION

1. Field of the Invention

The present invention relates to a nonwoven fabric made from filaments and to artificial leather containing it. More specifically, the invention relates to a nonwoven fabric made from filaments which can be used with advantage as a base fabric for artificial leather, and to artificial leather made using the nonwoven fabric.

2. Description of the Related Art

Artificial leather used as a leather substitute in recent years has become popular among consumers due to its features such as lightness and ease of care, and it has come into wide use in the fields of clothing, general materials, sports, etc. However, artificial leather is desired to have a softness, a drape property which arises from the dense structure, and the like, as provided by natural leather, and several proposals have been set forth to provide such desired properties.

In particular, various nonwoven fabrics made from filaments have been proposed (Japanese Examined Patent Publication No. 44-29543, No. 60-12465, etc.) because, unlike nonwoven fabrics made from staple fibers, they do not require a series of large-scale equipment such as a staple fiber feed unit, opening machine, carding machine, crosslapper, etc. for their production, while being made from filaments, they have a major advantage of strength over tangled nonwoven fabrics of staple fibers.

In addition, since nonwoven fabrics made from filaments also require no carding step, unlike nonwoven fabrics made from staple fibers, there is no need to form high crimps into the fibers and filament nonwoven fabrics can be made directly from fine denier filaments, while the ratio of space between the fibers can be easily reduced to make the nonwoven fabric dense.

For an improved appearance, there has been proposed, in Japanese Examined Patent Publication No. 59-42108, a nonwoven fabric with excellent softness and excellent abrasion resistance, which comprises an intertwined nonwoven fabric made from a resin and an aggregate of fine denier filaments with a denier of 0.3 de or less and which exhibits a high tearing strength. However, at least one of the surfaces is a side formed by the filaments and the resin, and is different from a suede-like erected pili surface, or a smooth surface consisting of the polymer alone, i.e. a "full-grain surface".

In Japanese Unexamined Patent Publication No. 3-213555 there is proposed a nonwoven fabric consisting of bicomponent splittable fibers. The patent publication states that the nonwoven fabric can be used for medical uses, for bags, and the like, but despite the high strength due to partial bonding of the fibers by at least the resin among the fiber forming components, there is too much repulsion, rendering it unsuitable particularly as artificial leather for clothing.

There is also proposed, in Japanese Unexamined Patent Publication No. 10-53948, a method whereby aggregates of splittable fibers as the starting fibers are subjected to force tangling by needle punching or a method of tangling by high pressure water stream, and a nonwoven fabric obtained by splitting the filaments is heated in boiling water or steam for heat shrinkage to achieve further densification.

Artificial leather obtained using a nonwoven fabric prepared in this manner has a high apparent density due to the heat shrinkage which also provides a densified structure, so that the artificial leather has a full and tight handling property, but it lacks softness, and, in the case of forming artificial leather with full grain wherein a coating such as a film consisting of high elastic polymer or the like is formed on the surface of the artificial leather, large buckling creases occur when the artificial leather is folded, constituting an inherent critical defect; thus, a problem occurring when such artificial leather, particularly full-grain artificial leather is used to produce shoes, bags, gloves or furniture, is that the initial appearance deteriorates with use.

On the other hand, even in the case of suede-like artificial leather, it has not yet been possible to obtain products with dense erected pili and a pleasant surface touch similar to natural leather, and therefore an artificial leather has been desired which is endowed with an natural leather-like feeling of softness and limited stretching, as well as a beautiful appearance.

SUMMARY OF THE INVENTION

It is a first object of the present invention to overcome the aforementioned problems of the prior art by providing a nonwoven fabric made from filaments with which it is possible to prepare artificial leather as full-grain artificial leather which exhibits both the softness and full and tight handling property of natural leather while also having no buckling creases upon folding and being resistant to formation of buckling creases, or nubuck-like artificial leather with an excellent fine touch similar to baby-skin, which has not existed in the prior art.

It is a second object of the invention to provide artificial leather which is prepared from the above-mentioned nonwoven fabric made from filaments.

The present inventors focused on the structure of nonwoven fabric as the reason for both softness and a tight handling property and excellent suede-like surface touch and as the cause of buckling creases upon folding of full-grain leather (hereunder referred to simply as "buckling creases") in artificial leather prepared using nonwoven fabric made from filaments as the base fabric, and upon carrying out diligent research on the properties of nonwoven fabric structures made from tangled fine denier filaments and on methods for forming them, they have found that artificial leather with both softness and a tight handling property requires that the nonwoven fabric have a high density and that the number of fiber bundles oriented in the direction of thickness of the artificial leather be within a specific range.

It was also found that buckling creases in full-grain artificial leather which occur when using splittable-type multicomponent filaments are a result of the structure unique to splittable-type multicomponent filaments, wherein the splittable fine denier filaments are still in an aggregated state with the distance between them being close that that in the state of orientation as multicomponent filaments, with the nonwoven fabric including macrospaces of 800 $\mu m^2$ or greater. In other words, it was found that the buckling creases in full-grain artificial leather occur because of the multifilament state formed by aggregations of fine denier filament groups produced by splitting from monofilaments of the splittable-type multicomponent filaments, resulting in tangling of the splittable-type multicomponent filaments which forms macrospaces within the nonwoven fabric that are not filled by the fine denier filament groups.

On the other hand, it was also found that in the case of nonwoven fabrics made from filaments formed from islands-in-a-sea type multicomponent filaments, the feeling of softness and a full and tight handling property like natural leather, and the surface touch of nubuck-like artificial leather can be obtained by a specific structure having the fiber bundles described above, and by the properties arising from those fiber bundles, upon which the present invention was thus completed.

In other words, the first object of the invention can be achieved by a nonwoven fabric made of filaments, which comprises filaments formed from a fiber-forming thermoplastic polymer and satisfies all of the following conditions (A) to (D).

(A) The fiber bundles are present in a range of 5–70 per centimeter in any cross-section parallel to the direction of thickness of the nonwoven fabric.

(B) The total area occupied by the fiber bundles is in a range of 5–70% of the cross-sectional area of any cross-section perpendicular to the direction of thickness of the nonwoven fabric.

(C) The apparent density is 0.10–0.50 g/cm$^3$.

(D) The cut ends of the fibers on the nonwoven fabric surface are present in a range of 5–100 per mm$^2$ of surface area.

The second object of the invention can be achieved by artificial leather comprising the nonwoven fabric according to the invention and a polymeric elastomer impregnated therein and satisfies all of the following conditions (I) to (N).

(I) The fiber bundles are present in a range of 5–70 per centimeter in any cross-section parallel to the direction of thickness of the artificial leather.

(J) The total area occupied by the fiber bundles is in a range of 5–70% of the cross-sectional area of any cross-section perpendicular to the direction of thickness of the artificial leather.

(K) At least a portion of the impregnated polymeric elastomer is polymeric elastomer which is not fixed among the fibers.

(L) The tensile stress at 20% elongation ($\sigma 20$) in the warp direction and the tensile stress at 20% elongation ($\sigma 20$) in the weft direction of the artificial leather are each in the range of 1.5–10 kg/cm.

(M) The ratio of the 20% elongation ($\sigma 20$) in the warp direction to the bending resistance (Rb (g/cm)) for the artificial leather and the ratio of the 20% elongation ($\sigma 20$) in the weft direction to the bending resistance (Rb (g/cm)) for the artificial leather have an average value of 3–30.

(N) The apparent density of the artificial leather is 0.20–0.60 g/cm$^3$.

DESCRIPTION OF THE PREFERRED EMBODIMENTS

Figure 1:
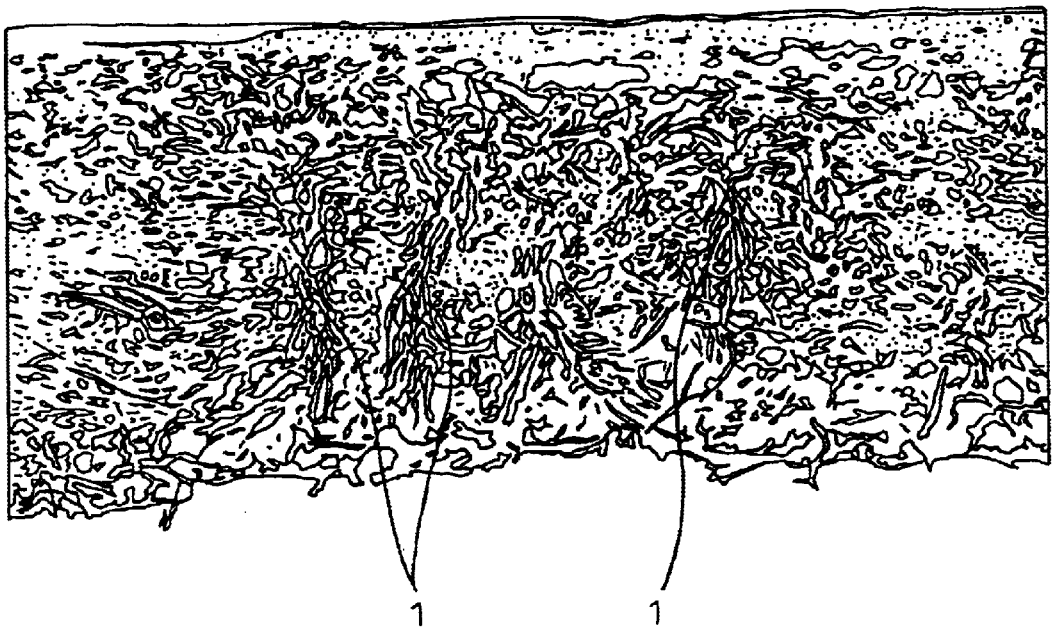
FIG. 1 is a cross-sectional view parallel to the direction of thickness of artificial leather comprising a nonwoven fabric made from filaments according to the invention, which was sketched from the electron micrograph (35×) of FIG. 4.

First, conditions (A) to (D) for the nonwoven fabric made of filaments according to the invention will be explained in detail. These conditions are essential for the nonwoven fabric made of filaments as a base fabric which can be used to obtain an artificial leather which has not existed in the prior art.

According to condition (A), the number of fiber bundles must be in a range of 5–70 per centimeter width in any cross-section parallel to the direction of thickness of the nonwoven fabric made of filaments.

This is the structure which appears by the intertangling treatment at the nonwoven fabric stage described below, wherein the filaments which tend to align parallel to the surface are sufficiently intertangled in the direction of thickness of the nonwoven fabric, resulting in lower bending resistance when artificial leather is prepared, so that a structure is provided with denseness together with softness and both a full and tight handling property. By alignment in the direction of thickness it is possible to achieve an effect of greatly improved interlayer adhesion strength while exhibiting suitable compression elasticity.

If the number of filaments in the fiber bundle is less than 5 per centimeter of width, the aforementioned effect will not be adequately exhibited, and if it is greater than 70 it will become difficult in practice to accomplish intertwining of the filaments. A preferred range for the number of fiber bundles is 10–50.

According to condition (B), the total area occupied by the fiber bundles must be in a range of 5–70% of the cross-sectional area of any cross-section perpendicular to the direction of thickness of the nonwoven fabric.

The fiber bundles can be easily observed in any cross-section perpendicular to the direction of thickness of the nonwoven fabric made of filaments, and by occupying the area ratio specified above, it is possible to obtain a structure with enough intertangling of nonwoven fabric, and which allows both denseness and softness when made into artificial leather and an excellent erected pili touch on the surface when made into nubuck-like artificial leather. If the occupied total ratio is less than 3% the above-mentioned effect will be inadequately exhibited, and if it exceeds 70% it will become difficult to accomplish practical intertangling of the filaments. A preferred range for the occupied area is 8–50%.

The number of fiber bundles in any cross-section perpendicular to the direction of thickness of the nonwoven fabric is preferably 2–20 per $mm^2$ of cross-sectional area.

Condition (A) and condition (B), which are essential conditions for the nonwoven fabric of the invention, impart the softness which could not be exhibited by artificial leather made from nonwoven fabric made of filaments known to the prior art, and provide the necessary structure for the repulsion elasticity to be in the range specified by the present invention.

According to condition (C), the apparent density of the nonwoven fabric made of filaments must be 0.10–0.50 $g/cm^3$. The apparent density provides a uniform structure for the nonwoven fabric made of filaments and contributes to the tight handling property and drape property of the resulting nonwoven fabric made of filaments, and it is preferably 0.20–0.40 $g/cm^3$. If the apparent density is less than 0.10 $g/cm^3$ a nonwoven fabric with a uniform, dense structure cannot be obtained, and if it is greater than 0.50 $g/cm^3$ the drape property of the nonwoven fabric will be inferior despite a tight handling property.

According to condition (D), the cut ends of the fibers on the surface of the nonwoven fabric made of filaments must be present in a range of 5–100 per $mm^2$ of surface area. This is because a certain degree of cutting of the filaments which tend to be aligned parallel to the surface of the nonwoven fabric imparts softness to the nonwoven fabric. Without at least 5 cut ends per $mm^2$, softness will not be exhibited despite the cut ends which are present, and when artificial leather is prepared in the manner described it will not be possible to achieve softness. Conversely, if there are more than 100 cut ends per $mm^2$ the strength of the nonwoven fabric will be reduced. A preferred range for the number of cut ends is therefore 10–50/$mm^2$.

The above ranges will apply for the number of cut ends in the nonwoven fabric after splitting when splittable-type multicomponent filaments are used as the filaments, and for the number of cut ends in the nonwoven fabric prior to extrusion and removal of the sea components when mixed polymer filaments and/or multicore filaments are used as the filaments.

Figure 2:
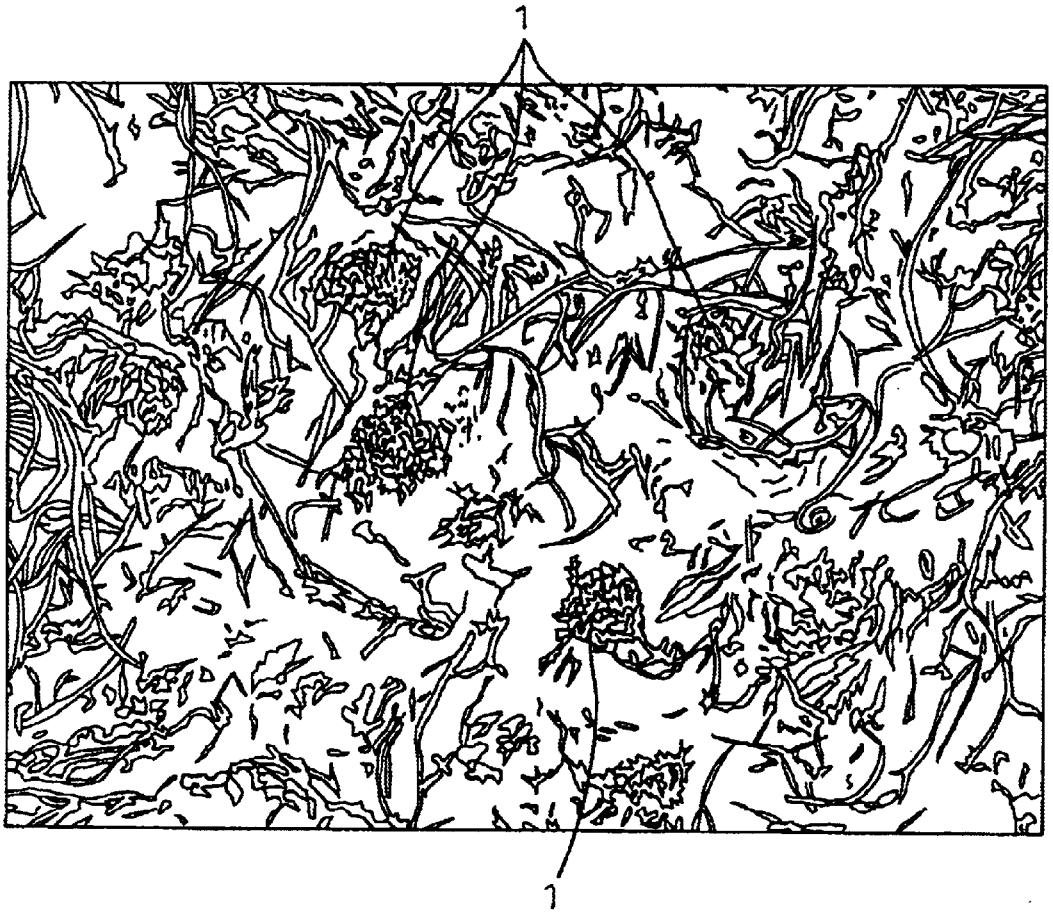
FIG. 2 is a cross-sectional view perpendicular to the direction of thickness of artificial leather comprising a nonwoven fabric made from filaments according to the invention, which was sketched from the electron micrograph (50×) of FIG. 5.
Figure 4:
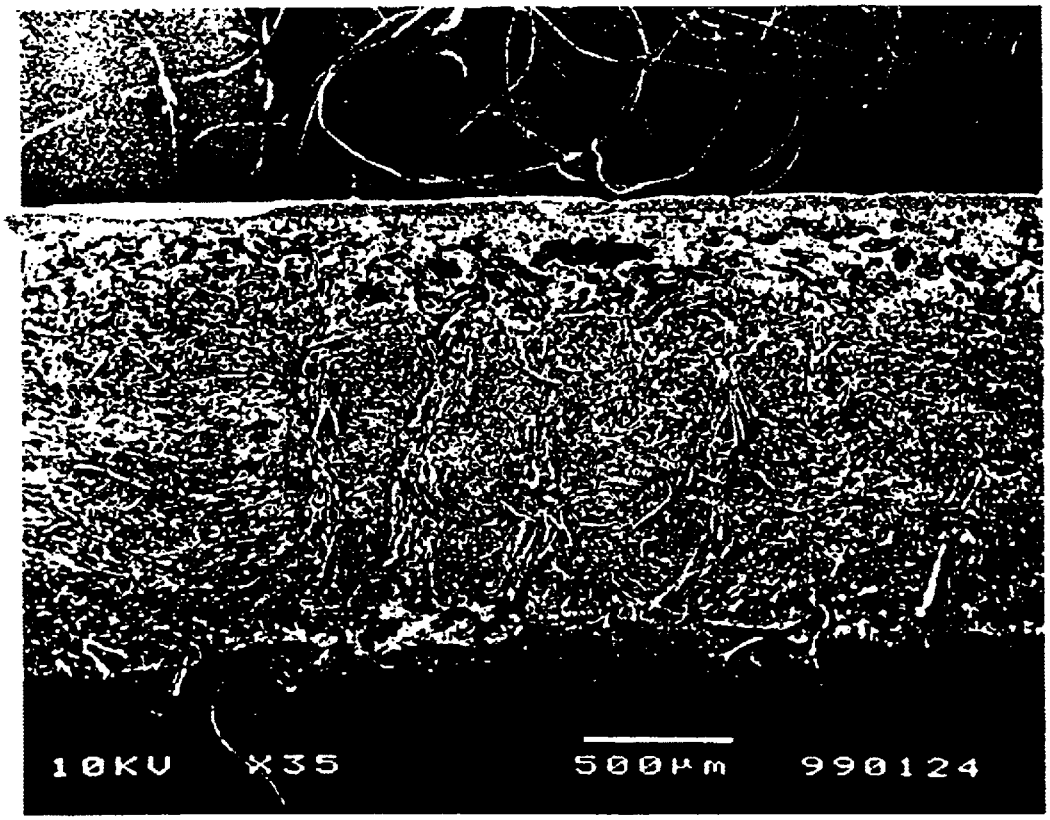
FIG. 4 is an electron micrograph (35×) showing the state of fiber bundles in a cross-section parallel to the direction of thickness of artificial leather obtained by the procedure of Example 7.
Figure 5:
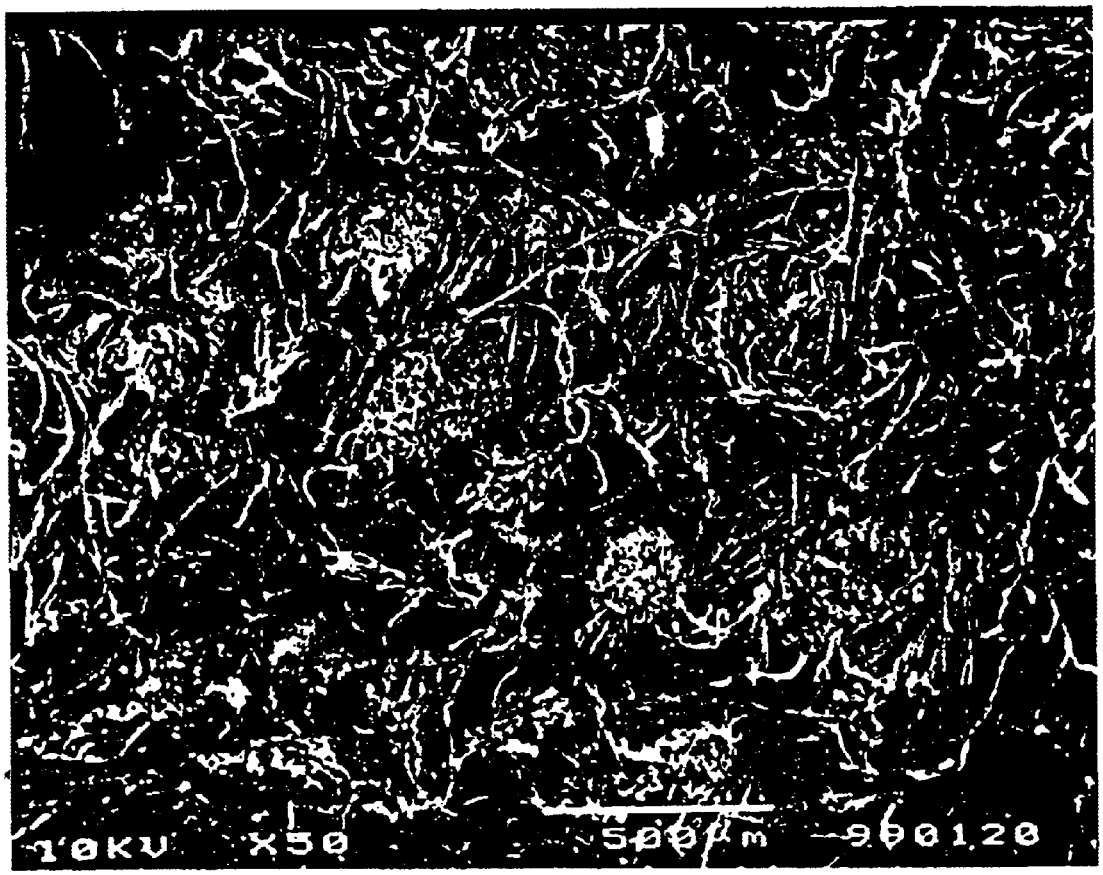
FIG. 5 is an electron micrograph (50×) showing the state of fiber bundles in a cross-section perpendicular to the direction of thickness of artificial leather obtained by the procedure of Example 7.

"Fiber bundle" and conditions (A) and (B) according to the invention will now be explained more concretely and in detail with reference to the attached drawings. FIG. 1 and FIG. 2 are, respectively, a cross-sectional view parallel to the direction of thickness and a cross-sectional view perpendicular to the direction of thickness of artificial leather obtained using the nonwoven fabric made from filaments in Example 6 of the invention, and they were sketched from the electron micrographs (35×) of FIG. 4 and FIG. 5 (50×) which show, respectively, a cross-sectional view parallel to the direction of thickness and a cross-sectional view perpendicular to the direction of thickness of artificial leather obtained using the nonwoven fabric made from filaments in Example 6.

The numerals 1 in FIG. 1 and FIG. 2 represents the "fiber bundle" according to the invention, and indicate the filaments that are arranged in bundle form roughly parallel to the direction of thickness of the nonwoven fabric made of filaments, with bundle sizes of 20–500 $\mu$m, and with a length of at least half of the thickness of the nonwoven fabric made of filaments in the parallel direction to the thickness of the nonwoven fabric. "Per centimeter of width" means per centimeter of linear distance in the selected cross-section of the nonwoven fabric, perpendicular to the direction of thickness of the nonwoven fabric.

The fiber bundles are preferably composed of fine denier fibers, the fine denier fibers being either in dense or rough aggregates, and when using filaments capable of forming fine fiber bundles, for example islands-in-a-sea type filaments, there is no problem with using them prior to extraction and removal of the sea component of the fibers, so long as it is possible to induce microfibers after forming the nonwoven fabric made of filaments or after obtaining the artificial leather.

Figure 3:
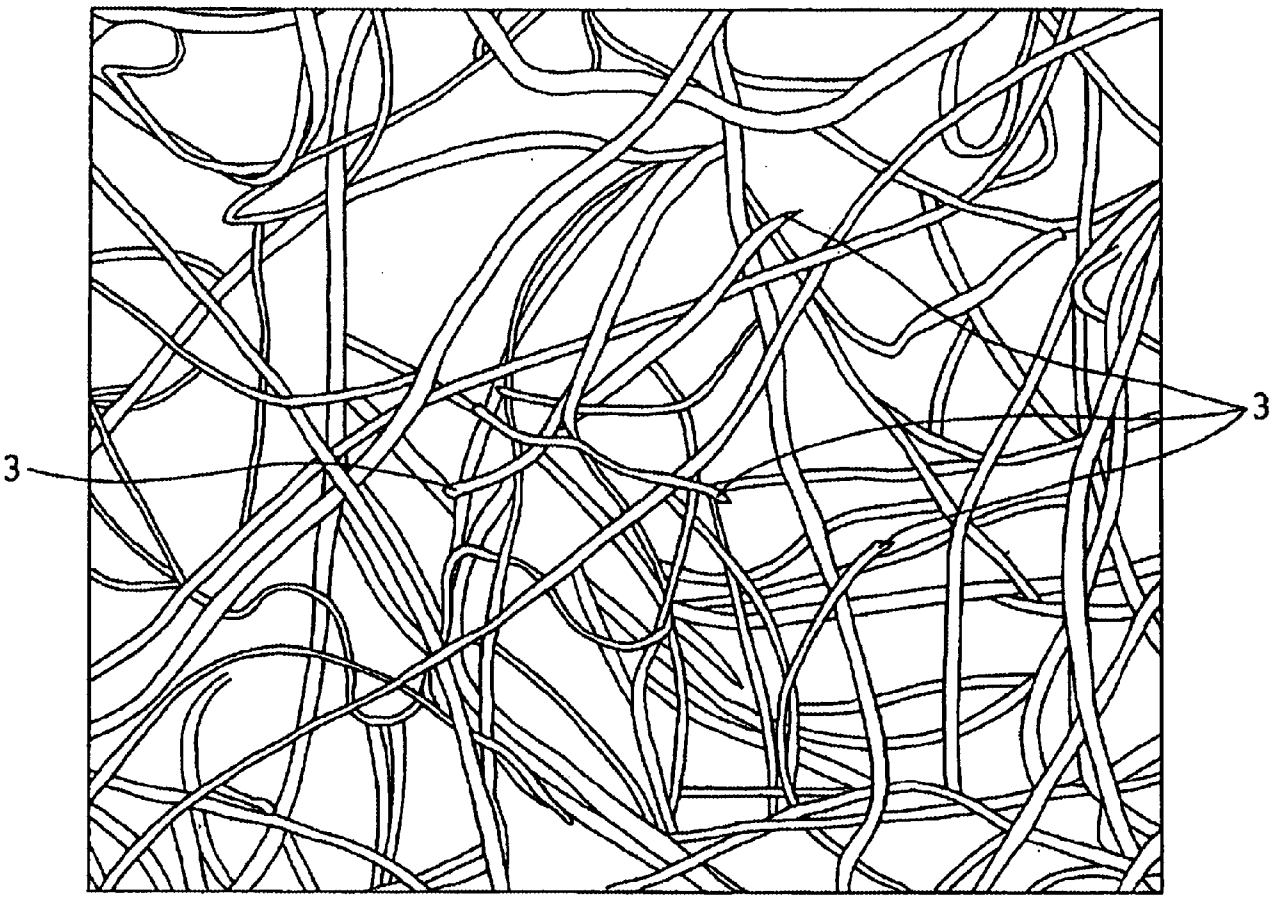
FIG. 3 is a view of the surface of a nonwoven fabric made from filaments according to the invention, which was sketched from the electron micrograph (200×) of FIG. 6.
Figure 6:
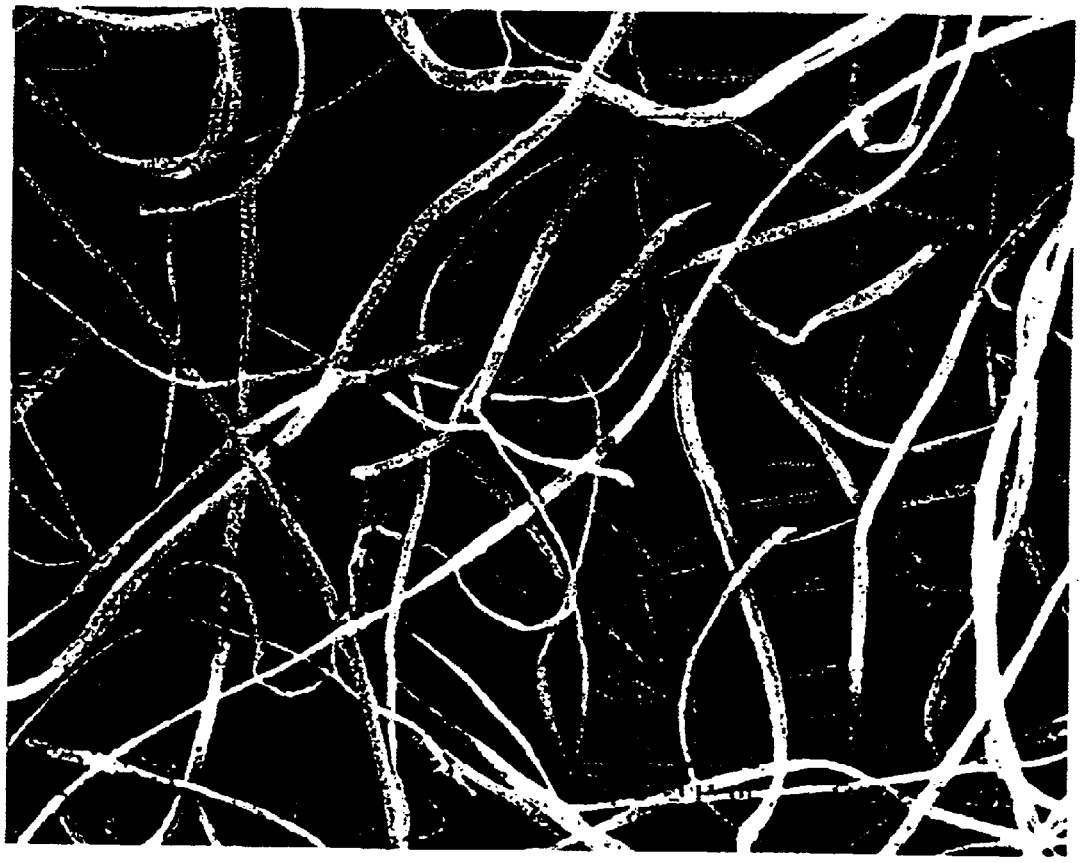
FIG. 6 is an electron micrograph (200×) showing the state of cut ends of fibers on the surface of a nonwoven fabric made of filaments obtained by the procedure of Example 3.

Condition (D) according to the invention will now be explained more concretely and in detail with reference to the attached drawings. FIG. 3 is a view of the surface of a nonwoven fabric made from filaments according to the invention, and it was sketched from the electron micrograph (200×) of FIG. 6 which shows the surface of a nonwoven fabric made of filaments obtained by the procedure of Example 3. The numerals 3 in FIG. 3 indicate the cut ends of the filaments, and the cut ends are present at a density of 20/$mm^2$.

Figure 7:
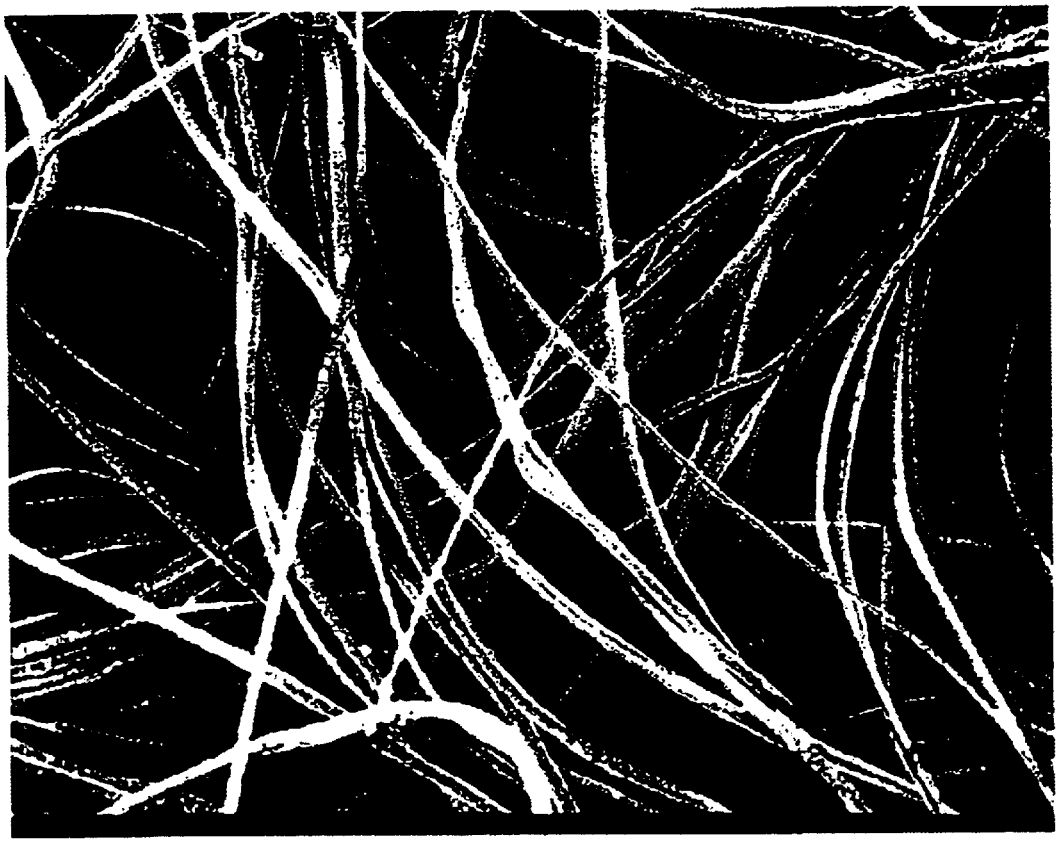
FIG. 7 is an electron micrograph (200×) showing the surface of a nonwoven fabric made of filaments obtained by the procedure of Comparative Example 3.

For comparison, FIG. 7 shows an electron micrograph of the surface of a nonwoven fabric made of filaments known in the prior art, which was obtained in Comparative Example 4. As is clear by comparing the photograph of FIG. 7 with the photograph of FIG. 6 which shows the surface of a nonwoven fabric made of filaments according to the present invention, the cut ends of the filaments are present at one filament per $mm^2$ in the surface of the nonwoven fabric made of filaments in FIG. 7, and as mentioned above, the range for the number of cut ends of filaments in the nonwoven fabric made of filaments according to the present invention is specified to exhibit desirable surface softness.

According to the invention, the compression percentage in the direction of thickness of the nonwoven fabric made of filaments is preferably in the range of 10–30%. The compression percentage is determined by preparing a 100 mm×100 mm sample, mounting it on a level platform, measuring the thickness (A) at the center of the sample with a load of 80 $g/cm^2$ applied, measuring the thickness (B) at the same position with a load of 500 $g/cm^2$ applied, and then calculating $[(A-B)/A]\times 100$ (%); it serves as a measure of the decrease in thickness of the nonwoven fabric under a load with respect to the original thickness, and the hardness of the resulting nonwoven fabric is even more satisfactory when the compression percentage is within the aforementioned range. The compression percentage is more preferably in the range of 12–18%.

According to the invention, when the nonwoven fabric made of filaments consists of fine denier filaments obtained from splittable-type multicomponent filaments comprising a polymer with two or more components, it preferably satisfies the following conditions (E) to (H).

(E) The denier of the filaments is 0.01–0.5 de.

(F) The apparent density of the nonwoven fabric is 0.25–0.45 $g/cm^3$.

(G) The average area of space in any cross-section of the nonwoven fabric is 70–300 $\mu m^2$ as measured by a method of image analysis with a scanning electron microscope.

(H) The structure has uniformity represented by a standard deviation of space area in any cross-section of the nonwoven fabric of 200–450 $\mu m^2$ as measured by a method of image analysis with a scanning electron microscope.

These conditions will now be explained. With a single filament denier of 0.01–0.5 de composing the nonwoven fabric made of filaments according to condition (E), it becomes even easier to impregnate the polymeric elastomer when preparing the artificial leather, while also becoming easier to obtain a nonwoven fabric with a uniform fine structure as one of the objects of the invention.

According to condition (F), the apparent density is preferably 0.25–0.45 g/cm$^3$, with an especially preferred range being 0.3–0.40 g/cm$^3$. When this range is satisfied, the fabric has a more excellent tight handling property and drape property exhibited by the uniform structure of the nonwoven fabric by shrinkage.

According to conditions (G) and (H), the average area of space in any cross-section of the nonwoven fabric made of filaments according to the invention is limited to 300 $\mu$m$^2$ at most, in contrast to the macrospaces of 800 $\mu$m$^2$ and greater of nonwoven fabrics of the prior art, which lead to buckling creases. However, from the standpoint of the tight handling property and drape property of the nonwoven fabric which is unrelated to buckling creases, the area is preferably at least 70 $\mu$m$^2$. If the average area is less than 70 $\mu$m$^2$ the resulting nonwoven fabric will have a tight handling property due to the high density and uniform denseness not obtained by the prior art, but the drape property of the nonwoven fabric will sometimes be low.

Similar to the average area, the standard deviation of space area is also limited to 450 $\mu$m$^2$ at most, in contrast to the macrospaces of 800 $\mu$m$^2$ and greater of nonwoven fabrics of the prior art, which lead to buckling creases. A standard deviation exceeding 450 $\mu$m$^2$ implies that macrospaces can diffuse even if the average values are within the target ranges of the invention, and this will tend to result in buckling creases. On the other hand, while a smaller deviation is preferred for a more uniform structure, about 200 $\mu$m$^2$ is the practical limit.

The space area according to the invention was measured by image analysis with a scanning electron microscope, as described in the examples which follow.

A nonwoven fabric made of fine denier filaments according to the invention comprising splittable-type multicomponent filaments which satisfy all of the conditions (E) to (H) is useful as a nonwoven fabric made of filaments to be prepared into full-grain artificial leather which has virtually no macrospaces and a uniform dense structure, with a soft feel and no buckling creases.

Furthermore, if the filaments composing the nonwoven fabric made of filaments according to the invention are islands-in-a-sea type multicomponent filaments containing a fiber-forming thermoplastic polymer as the island component and a polyolefin-based polymer as the sea component, it is possible to achieve an islands-in-a-sea type cross-section for mixed polymer filaments or an islands-in-a-sea type cross-section for multicore filaments.

The filaments composing the nonwoven fabric made of filaments according to the invention can also be islands-in-a-sea type splittable multi-layered type filaments with each segment consisting of a mixed polymer comprising the polymer blend (a) and polymer blend (b) described below.

Polymer Blend (a):

A polymer blend comprising a fiber-forming thermoplastic polymer (A) as the island component and a polyolefin-based polymer (B) as the sea component.

Polymer Blend (b):

A polymer blend comprising a fiber-forming thermoplastic polymer (A') as the island component and a polyolefin-based polymer (B') as the sea component.

No problems will be presented if the fiber-forming thermoplastic polymer used to form the filaments is any one or more polymers selected from the group consisting of polyethylene terephthalate, copolymerized polyethylene terephthalate containing at least 80 mole percent ethylene terephthalate units, nylon 6, nylon 66, nylon 610, nylon 12, polypropylene, polyurethane elastomer, polyester elastomer and polyamide elastomer.

The artificial leather of the invention will now be explained.

The artificial leather of the invention comprises the nonwoven fabric according to the invention described above and a polymeric elastomer impregnated therein and satisfies all of the following conditions (I) to (N).

(I) The fiber bundles are present in a range of 5–70 per centimeter of width in any cross-section parallel to the direction of thickness of the artificial leather.

(J) The total area occupied by the fiber bundles is in a range of 5–70% of the cross-sectional area of any cross-section perpendicular to the direction of thickness of the artificial leather.

(K) At least a portion of the impregnated polymeric elastomer is polymeric elastomer which is not fixed among the fibers.

(L) The tensile stress at 20% elongation ($\sigma$20) in the warp direction and the tensile stress at 20% elongation ($\sigma$20) in the weft direction of the artificial leather are each in the range of 1.5–10 kg/cm.

(M) The ratio of the 20% elongation ($\sigma$20) in the warp direction to the bending resistance (Rb (g/cm)) for the artificial leather and the ratio of the 20% elongation ($\sigma$20) in the weft direction to the bending resistance (Rb (g/cm)) for the artificial leather have an average value of 3–30.

(N) The apparent density of the artificial leather is 0.20–0.60 g/cm$^3$.

According to condition (I), the fiber bundles must be present in a range of 5–70 per centimeter of width in any cross-section parallel to the direction of thickness of the artificial leather. When the number of fiber bundles is within this range, the artificial leather has suitable bending strength and a dense structure, while also having a feeling of softness and both a full and tight handling property.

The number of fiber bundles is also a condition for providing the nonwoven fabric to be prepared into artificial leather according to the invention. A preferred range for the number of fiber bundles is 10–50.

According to condition (J), the total area occupied by the fiber bundles must be in a range of 5–70% of the cross-sectional area of any cross-section perpendicular to the direction of thickness of the artificial leather.

The total area contributes both denseness and softness as artificial leather and to an excellent erected pili touch on the surface when made into nubuck-like artificial leather; when the total area is less than 5% the above-mentioned effect will be inadequately exhibited, and when it exceeds 70% it will become difficult to accomplish practical intertangling of the filaments. A preferred range for the occupied area is 8–50%.

According to condition (K), at least a portion of the polymeric elastomer impregnated in the nonwoven fabric must be not fixed among the fibers.

A full feel is usually provided in artificial leather by impregnation of a polymeric elastomer in the nonwoven fabric, etc. serving as the substrate, but when the fibers are completely adhered and fixed together by the polymeric elastomer, the elasticity of the polymeric elastomer comes to be overly reflected in the properties of the artificial leather, so that the softness of natural leather cannot be achieved.

According to condition (L), the tensile stress at 20% elongation ($\sigma$20) in the warp direction and the tensile stress at 20% elongation (σ20) in the weft direction of the artificial leather must be each in the range of 1.5–10 kg/cm. If the tensile stress is less than 1.5 kg/cm the limited stretching feel will be insufficient and the handle will be loose, while if it exceeds 10 kg/cm it will become difficult to achieve softness. A preferred range is 2–6 kg/cm.

Here, the warp and weft directions of the artificial leather are two axial directions which are perpendicular on the plane among the entire azimuth on the plane perpendicular to the direction of thickness of the artificial leather, and the direction of width during production of the nonwoven fabric made of filaments is designated as the weft direction while the other direction is designated as the warp direction.

According to condition (M), the ratios of the 20% elongation (σ20) to the bending resistance (Rb (unit g/cm)) (σ20/Rb) in the warp direction and the weft direction must have an average value of 3–30. Here, the bending resistance (Rb) represents the repulsion force upon bending the artificial leather by a curvature radius of 2 cm, and a lower value indicates greater softness. The bending resistance is more preferably in the range of 0.1–3.

Thus, a larger (σ20/Rb) indicates greater softness and a tighter handle, and a greater feeling of limited stretching, but if it is too large the tightness will be lost. The average value for the warp direction and weft direction is preferably 5–20.

As regards condition (N), the apparent density of the artificial leather contributes to its uniform structure and tight handling property and drape property; if the apparent density is less than 0.20 g/cm$^3$ a uniform and dense structure cannot be achieved, and if the apparent density is greater than 0.60 g/cm$^3$, the hand will be tight but the artificial leather will have a hard feel. Consequently, it is essential for the apparent density to be in the range of 0.20–0.60 g/cm$^3$, and it is preferably 0.30–0.50 g/cm$^3$.

When the substrate used is a nonwoven fabric made of filaments consisting of fine denier filaments obtained from splittable-type multicomponent filaments comprising the aforementioned 2 or more polymers and satisfying the above-mentioned conditions (E) to (H), the artificial leather preferably also satisfies all of the following conditions (O) to (Q).

(O) The fiber bundles are present in a range of 10–50 per centimeter of width in any cross-section parallel to the direction of thickness of the artificial leather.

(P) The average area of space in any cross-section of the artificial leather is 70–140 $\mu$m$^2$ as measured by a method of image analysis with a scanning electron microscope.

(Q) The structure has uniformity represented by a standard deviation of space area in any cross-section of the artificial leather of 80–200 $\mu$m$^2$ as measured by a method of image analysis with a scanning electron microscope.

These conditions will now be explained. Under condition (O), it is possible for the artificial leather to have a structure with suitable bending strength and a dense structure, while also exhibiting an even softer feel and a full and tight handling property. The number of fiber bundles is particularly preferred to be 12–30. "Per centimeter of width" means per centimeter of linear distance in the cross-section of the artificial leather, perpendicular to the fiber bundle.

According to conditions (P) and (Q), similar to the nonwoven fabric made of filaments used in the artificial leather, the average area of space measured by a method of image analysis with a scanning electron microscope and formed by the filaments and the polymeric elastomer in a cross-section of the artificial leather is preferably 70–140 $\mu$m$^2$, and the standard deviation value thereof is preferably in the range of 80–200 $\mu$m$^2$. This further reduces macrospaces present in the nonwoven fabric made of filaments.

The resin-impregnated artificial leather preferably has no spaces of 400 $\mu$m$^2$ or greater in order to obtain artificial leather with full grain and no buckling creases, and within the range specified above it is possible to obtain artificial leather with a dense structure, which produces no buckling creases even which prepared as full-grain artificial leather, and which has an even higher level of softness and drape property.

The standard deviation value representing uniformity is preferably in the range of 50–200 $\mu$m$^2$, because when it is within this range, diffusion of macrospaces is further inhibited, and buckling creases occurring in the case of full-grain artificial leather are further inhibited.

When the fiber bundles in the nonwoven fabric made of filaments and the artificial leather according to the invention described above are fiber bundles obtained from splittable-type multicomponent filaments, the number of filaments preferably corresponds to about 10–1000 with a denier of, for example, 0.2 denier after splitting, and in the case of islands-in-a-sea type of multicomponent filaments as the structural fibers, the number of filaments prior to inducing microfibers (prior to extraction of the sea component) preferably corresponds to about 1–500 with a denier of, for example, 4 prior to inducing microfibers. If the number of fiber bundles is within this range, a uniform structure will be provided, and the aforementioned effect obtained by the presence of the fiber bundles will be more notably exhibited. The lateral cross-sectional shape of the fiber bundles is preferably isotropic, i.e. circular, and it may be a nearly circular shape, such as an oval.

A method of producing the nonwoven fabric made of filaments and the artificial leather of the invention will now be described.

The filaments composing the nonwoven fabric may be fine denier filaments from splittable-type multicomponent filaments or filaments which can yield microfibers, such as islands-in-a-sea type multicomponent filaments, or fine denier filaments obtained therefrom, and they may be fine denier filaments directly produced by a method of superdrawing, etc.; however, filaments derived from islands-in-a-sea type multicomponent filaments or splittable-type multicomponent filaments are particularly preferred.

The lateral cross-sectional shape of the filaments may be any known lateral cross-sectional shape such as circular, oval, rectangular, multilobal cross-sectional, hollow cross-sectional, etc.

The thermoplastic polymers composing the filaments may be hitherto known thermoplastic polymers such as polyesters, polyamides, polyolefins, elastomers and the like, and aromatic polyamides, fluorinated polymers and the like may also be used. In addition, so long as the object of the invention is not hindered, there may also be added carbon black, titanium oxide, aluminum oxide, silicon oxide, calcium carbonate, mica, fine metal powders, organic pigments, inorganic pigments and the like, which additives have coloring effects for polymers and also effects of raising or lowering the melt viscosity of the polymers, and are effective for adjusting the area and shape of the lateral cross-section of the filaments.

Production of a nonwoven fabric made of filaments comprising splittable-type multicomponent filaments will now be explained. The fiber-forming thermoplastic polymer composing the splittable-type multicomponent filaments may be a combination of any polymers so long as they are not mutually compatible, among which polyester and polyamide combinations are particularly preferred.

In this case, as polyesters there may be mentioned polyethylene terephthalate-based polyesters, polybutylene terephthalate-based polyesters and the like, but particularly preferred are polyesters with anticrystallization components copolymerized or included therewith, which are able to increase the heat shrinkage after tangling and splitting.

These polyesters may be used either alone or in combinations of two or more, and for example, a polyester containing metal salt sulfonate groups may be combined with a polyester containing no sulfonate groups.

As polyamides there may be mentioned nylon 6, nylon 66, nylon 610, nylon 12, polyphthalamide and the like.

Other fiber-forming thermoplastic polymers which may be used include polypropylene, polyethylene, polyurethane elastomer, polyester elastomer, polyamide elastomer, polyolefin elastomer, etc. The most preferred combination of thermoplastic polymers in the splittable-type multicomponent filaments of the invention is polyethylene terephthalate and nylon 6.

The splittable-type multicomponent filaments have a structure wherein the two or more polymer components are mutually aligned in a radial manner in a lateral cross-section of the filaments, and while the number of alignments is not particularly limited, it is preferably 8–24 from the standpoint of process flow and splittability, and the splittability can be further increased if the lateral cross-section of the filaments is hollow. In this case, the hollow percentage is preferably no greater than 25% in order to prevent splitting during formation of the filaments, and thereby additionally improve the spinning stability. The spinning stability is the proportion of area in the hollow portions with respect to the lateral cross-sectional area of the filaments.

As a reference for the total area of the lateral cross-section of the filaments, the proportion of each component of the multiple components of the splittable-type multicomponent filaments is preferably 30–70%, and especially 40–60%, from the standpoint of splittability and spinnability of the filaments. The proportion is normally 50:50 when the number of alignments is an even number and only two components are present, but if the proportion is changed to 70:30 it is possible to include fine denier filaments with a different denier in the nonwoven fabric made of filaments. The denier of the splittable-type multicomponent filaments is determined from the number of splits and the denier after splitting, but it is generally preferred to be 1–10 de.

The splittable-type multicomponent filaments may be used in any well-known method for forming nonwoven fabrics made of filaments, such as the spunbond method or a method whereby the spinning filaments are drawn at low speed and then either wound or continuously meshed as a nonwoven fabric on a meshed table while opening with a high-speed drawing fluid. From the viewpoint of productivity in particular, it is preferred to employ a spunbond method whereby the filaments spun from a nozzle are drawn at high speed and injected onto a meshed table.

Here, the speed of the high-speed drawing may be a range of publicly known speed according to the prior art, and the spun fibers may be subjected to the high-speed drawing at such a speed through an ejector or air sucker. The fine filaments obtained by the high-speed drawing are meshed on the meshed net while being opened, and they may be blended, layered or mixed with other filaments or staple fibers while they are meshed on the net.

The other filaments or staple fibers used here are not particularly restricted so long as they allow the effect of the invention to be exhibited, but in order to obtain a nonwoven fabric made of filaments with a uniform dense structure, the proportion of other filaments which are blended or mixed therewith is preferably less than 30% of the total amount of filaments used.

The nonwoven fabric made of filaments obtained in this manner may be layered in multiple sheets or used alone, subjected to preliminary thermal adhesion if necessary, and wound up first or supplied continuously for forced three-dimensional tanglement. The tangling treatment further densifies the fill state of the filaments by a well-known means such as a method of punching with a needle using a needle punch or the like, a method of tangling the filaments by a high pressurized water stream, or a combination of these methods.

Nonwoven fabrics made of filaments which have been obtained by the conventional spunbond method result in virtually all of the filaments being aligned parallel to the plane perpendicular to the direction of thickness of the nonwoven fabric, and they have always lacked softness when used as base fabrics for artificial leather; simple shrinking treatment gives a dense structure as a nonwoven fabric, but the denseness and softness cannot be expressed when it is prepared into artificial leather.

The nonwoven fabric made of filaments according to the invention is characterized in that the fiber bundles aligned parallel to the direction of thickness of the nonwoven fabric are present within a specific range, and therefore tangling by needle punching is preferred for sufficient formation of the fiber bundles and three-dimensional tanglement. When the number of fiber bundles is with the specified range, it is possible to achieve softness when prepared into artificial leather. The presence of the fiber bundles can provide an effect of greatly improved intralayer adhesion strength of the nonwoven fabric made of filaments.

However, simple needle punching cannot produce the artificial leather to be obtained by the present invention because it causes severe cutting of the filaments and leads to lower strength of the nonwoven fabric.

It is therefore a feature of the invention that the number of the fiber bundles is within the range specified by the invention and, unlike any of the known techniques of the prior art, the filaments composing the nonwoven fabric are partially cut. They are not, of course, cut to a degree that would lower the strength of the nonwoven fabric, but active cutting within this range provides flexibility and softness, as well as a feel like natural leather, when artificial leather is prepared. For this purpose it is necessary to appropriately determine the oil, the shape of the needle, the depth of needling and the number of penetrations. Specifically, the oil should provide high filament/filament friction so that the tangled filaments will not loosen, and for example an aliphatic ester or polysiloxane may be used. The shape of the needle will be more efficient with a larger number of barbs, and this may be 1–9 barbs as a range in which needle breaking does not occur, while the barb depth is preferably 0.02–0.2 mm from the standpoint of tangling properties and needle smoothness. The depth of needling must be determined in consideration of various conditions based on the distance from the tip to the barbs of the needle, but a greater depth is preferred within a range where the needle tracking is not too strong. The number of penetrations is preferably 300–5000 P/cm$^2$.

It is a feature of the invention here that the number of the fiber bundles is within the range specified by the invention and unlike any of the known techniques of the prior art, the filaments composing the nonwoven fabric are partially cut. They are not, of course, cut to a degree that would lower the strength of the nonwoven fabric, but active cutting within this range provides flexibility and softness, as well as a feel like natural leather, when artificial leather is prepared. More specifically, in order to prevent unnecessary breakage of the filaments by the needle or damage to the needle, an oil must first be applied to the surface of the filaments at 0.5–5 wt % based on the weight of the filaments. The type of oil applied must be selected as one which will cause partial breakage of the filaments without lowering the friction between the filaments and between the filaments and the needle.

Since splitting of splittable-type multicomponent filaments is preferably accomplished simultaneously with the three-dimensional tangling treatment, it is more effective to carry out tanglement with a high pressure water stream after the needle punching, and for example, to obtain a nonwoven fabric with a weight of 150 g/cm$^2$, pressurized water flow with a water pressure of 50–200 kg/cm$^2$ may be sprayed from a nozzle with orifices of 0.05–0.5 mm diameter at spacings of 0.5–1.5 mm, 1–4 times each onto the surface and the back of the nonwoven fabric made of filaments.

Another method is mechanical and/or chemical splitting treatment after tangling, and the mechanical splitting treatment used may be any publicly known method, such as pressurization between rollers, ultrasonic treatment, impact treatment or rubbing treatment. Chemical splitting treatment used may be any publicly known method of the prior art, such as immersion in a chemical solution that causes swelling of at least one of the components composing the splittable-type multicomponent filaments, or a chemical solution which dissolves at least one of the components. These types of splitting treatment may be carried out alone or in combinations of two or more.

The nonwoven fabric made of filaments which has been subjected to such tangling and splitting treatment is preferably also subjected to thermal shrinking in a relaxed state. In the case of high pressure water stream treatment or chemical treatment and water washing, the thermal shrinking treatment may be carried out after drying at a temperature which leaves shrinkability, or the thermal shrinking treatment may be carried out directly.

The shrinkage percentage and apparent density can be easily adjusted by the shrinkage of the thermal shrinking components, the degree of intertangling and the heating temperature in the shrinking step of the splittable-type multicomponent filaments, and the extent of blending and mixing of other filaments.

In the nonwoven fabric made of filaments according to the invention, when the nonwoven fabric is made of filaments of different shrinkability, it is preferred for them to be multicomponent filaments wherein one of the components is thermally shrinkable, in order to eliminate macrospaces in the nonwoven fabric and induce a uniform dense structure, it is preferred for the difference in the thermal shrinkability of the thermally shrinkable component and the other component in warm water at 95° C. to be 5–50%, and especially 10–30%, and it is particularly preferred to carry out gentle shrinking treatment of the nonwoven fabric made of filaments comprising a mixture of 2 or more types of fine denier filaments with deniers of 0.01–0.5 de, in a relaxed state, in warm water at 70–100° C. and/or dry heating at 80–140° C., for about 20 seconds to 10 minutes, so as to give the nonwoven fabric an area shrinkage percentage of 5–50%.

The thermal shrinkage percentage according to the invention is determined from the shrinkage percentage upon shrinking the filaments in warm water at 95° C. for 30 minutes under a load of 0.5 g/de, and the shrinkage percentage is calculated as (length before shrinking treatment−length after shrinking treatment)/(length before shrinking treatment)×100%.

The area shrinkage percentage is calculated as [(area of nonwoven fabric made of filaments before shrinking−area of nonwoven fabric made of filaments after shrinking)/(area of nonwoven fabric made of filaments before shrinking)]×100 (%).

Here, a "relaxed state" means a state in which the nonwoven fabric made of filaments is advanced in one direction at an overfeed rate of 3–30%. According to the intent of the invention focusing on the area shrinkage percentage, the hem of the nonwoven fabric made of filaments which is perpendicular to the direction of advance of the nonwoven fabric made of filaments should preferably be kept in a non-held state. The overfeed rate may be set depending on the target area shrinkage percentage, but an overfeed rate in the range of 3–30% is preferred because this makes it easier to obtain an area shrinkage percentage of 5–50%.

A preferred form of shrinking treatment in this relaxed state is one in which the nonwoven fabric made of filaments is allowed to shrink in warm water in a further tension-relaxed state due to buoyancy, the temperature of the water being preferably 70–100° C., since more thorough shrinking treatment can be accomplished within this range. When the shrinking treatment is accomplished by dry heating, an atmosphere temperature of 80–140° C. is preferred because more thorough shrinking treatment can be accomplished within this range.

The shrinking treatment time in the relaxed state may be appropriately set from at least 20 seconds to 10 minutes in order to achieve an area shrinkage percentage of at least 5%, but when the shrinking treatment is carried out simultaneously with chemical splitting treatment, and the splitting treatment requires a time exceeding 10 minutes, the time required to complete the splitting treatment will take precedence as the appropriate time.

When the area shrinkage percentage is in the range of 5–50% it will be possible to obtain a nonwoven fabric with a more uniform dense structure, the apparent density of the nonwoven fabric made of filaments will be more suitable, and the nonwoven fabric will have an even higher level of tight handling and drape properties. In particular, when the apparent density is sufficiently increased in the tangling treatment stage and the densification by thermal shrinkage is set to be 10–30% in terms of the area shrinkage percentage, it is possible to accomplish more gentle thermal shrinking treatment to give a nonwoven fabric made of filaments which has a more uniform dense structure.

As a result, the volume of the spaces formed between the fine denier filaments becomes more refined, the volume of spaces between the filaments is smaller compared to nonwoven fabrics made of conventional fine denier filaments, while the number of spaces is increased, so that the resulting nonwoven fabric made of filaments is provided with the advantage of resistance to buckling creases even when prepared into full-grain artificial leather.

The above explanation concerns a production method to be employed when splittable-type multicomponent filaments are used as the filaments composing the nonwoven fabric made of filaments, but a production method using islands-in-a-sea type multicomponent filaments will now be explained.

The islands-in-a-sea type multicomponent filaments used may contain two or more types of fiber-forming thermoplastic polymers with different thermal shrinkability (the same types of polymers mentioned for splittable-type multicomponent filaments) as the island component and any desired polymer which can be easily removed by dissolution as the sea component. Mixed polymer filaments comprising a polymer blend of the sea component and the island component, or multicore/sheath filaments may be used, with any lateral cross-sectional shape of publicly known islands-in-a-sea type multicomponent filaments.

The islands-in-a-sea type multicomponent filaments can also be mixed multicomponent filaments comprising the polymer blend (a) and polymer blend (b) described below joined together in a multilayer fashion.

Polymer Blend (a):

A polymer blend comprising a fiber-forming thermoplastic polymer (A) as the island component and a polyolefin-based polymer (B) as the sea component.

Polymer Blend (b):

A polymer blend comprising a fiber-forming thermoplastic polymer (A') as the island component and a polyolefin-based polymer (B') as the sea component.

These polymers and polymer blended thermoplastic polymers can be the polymer types composing the aforementioned splittable-type multicomponent filaments, and the thermoplastic polymers (A) and (A') and the polyolefin polymers (B) and (B') may each be either the same or different.

The preparation of the nonwoven fabric made of filaments and the tangling treatment may be carried out in the same manner as when using splittable-type multicomponent filaments, and three-dimensional tanglement may be followed by dissolution and removal of the sea component with a desired solvent to obtain a nonwoven fabric made of filaments according to the invention.

The resulting nonwoven fabric made of filaments can be used with particular advantage as a base fabric for nubuck-like artificial leather, but since nubuck-like artificial leather requires a satisfactory artificial leather surface touch in addition to the features of full-grain artificial leather, it is necessary to increase the density of the erected pili.

The specified fiber bundles are very important here as a feature of the invention, and the fiber bundles must not only be aligned parallel to the direction of thickness, but the filaments composing the fiber bundles must also be partially cut, and the fiber bundles specified according to the invention can easily be formed by needle punching as carried out for cutting of the filaments in the same manner as when using splittable-type multicomponent filaments.

According to the invention, the nonwoven fabric made of filaments, such as a nonwoven fabric made of filaments comprising splittable-type filaments or nonwoven fabric made of filaments comprising islands-in-a-sea type multicomponent filaments, is made into a composite by impregnation of a polymeric elastomer for preparation into artificial leather.

As polymeric elastomers there may be mentioned synthetic resins such as polyvinyl chloride, polyamide, polyester, polyester-ether copolymer, polyacrylic acid-ester copolymer, polyurethane, neoprene, styrene-butadiene copolymer, silicone resin, polyamino acid and polyamino acid-polyurethane copolymer, natural polymer resins, and their mixtures, and if necessary there may also be added pigments, dyes, crosslinking agents, fillers, plasticizers and various stabilizers.

Polyurethane and its mixtures with other resins give a soft feel and are therefore preferred for use as polymeric elastomers.

The polymeric elastomer is impregnated into the nonwoven fabric of the invention as a solution or dispersion in an organic solvent, or as an aqueous solution or aqueous dispersion. The coagulation method employed may be any method commonly used in the prior art, and for example, the heat-sensitizing coagulation method is preferred as the method of drying, while the pore coagulation method by drying from a W/O type emulsion is more preferred. Another example is a wet method wherein the nonwoven fabric made of filaments which has been impregnated with a water-miscible organic solvent solution of the polymeric elastomer is passed through a coagulating bath composed mainly of water, for pore coagulation.

Preferably, for impregnation of the polymeric elastomer, the nonwoven fabric serving as the base fabric is first treated with an emulsion of silicone or the like, or the nonwoven fabric made of filaments serving as the base fabric is first treated with a water-soluble polymer such as PVA, to prevent the adhesion of the polymeric elastomer to the surface of the filaments so as to fully restrain the constituent filaments. Treatment of the surface of the filaments will allow suitable freedom of movement of the filaments and the polymeric elastomer against deformation and external stress, thus imparting softness.

Control of the amount of the impregnated polymeric elastomer can be easily accomplished by adjusting the concentration of the polymeric elastomer in the impregnation solution or by adjusting the wet pick-up of the impregnation solution during impregnation.

According to the invention, the weight ratio of the nonwoven fabric made of filaments serving as the base fabric and the impregnated polymeric elastomer is preferably from 97:3 to 50:50, and more preferably from 90:10 to 60:40, based on the total weight of the artificial leather. When the proportion of the polymeric elastomer is within such ranges, the resulting artificial leather will have better softness and tightness. According to the invention, the nonwoven fabric made of filaments serving as the base fabric of the artificial leather has a minimal presence of macrospaces in its structure and is uniform, so that even with a low amount of the polymeric elastomer for impregnation, the resulting artificial leather will have a tight handling property.

By raising the pili of the artificial leather of the invention it is possible to make suede-like or nubuck-like artificial leather, in which case dyeing can further increase its value.

The artificial leather of the invention can also be made into full-grain artificial leather by providing a coating of the polymeric elastomer on the surface. Conventional full-grain artificial leather has not been satisfactory from the standpoint of density and uniformity of the impregnated nonwoven fabric serving as the base fabric, and it has been prone to buckling creases. This drawback has been dealt with by rubbing the full-grain artificial leather to add buckling creases beforehand, so that the coating provided on the surface must be thicker than necessary.

In contrast, the artificial leather prepared from a nonwoven fabric made of filaments according to the invention is resistant to buckling creases regardless of the thickness of the coating formed as the full-grain face on the surface, and it has a tight handling property with softness and drape properties.

The method used to form the coating may be any publicly known formation method, and for example, a lamination method whereby the coating is formed on a release sheet which is then attached to the surface of the impregnated nonwoven fabric, a method of applying a W/O type emulsion of the polymer elastomer onto the surface of the impregnated nonwoven fabric and drying it to form a porous layer, and then subjecting this to embossing, gravure painting or the like to form a coating, a method of forming a coating by lamination on the surface of this porous layer, a method of applying a water-miscible organic solvent solution of the polymeric elastomer onto the surface of the impregnated nonwoven fabric and using a wet method for pore coagulation in a coagulating solution composed mainly of water to form a porous layer, and then subjecting this to embossing, gravure painting or the like to form a coating, or a method of forming a coating by laminating on the surface of this porous layer.

When islands-in-a-sea type multicomponent filaments are used as the filaments composing the nonwoven fabric made of filaments, the resulting nonwoven fabric made of filaments can be prepared mainly into nubuck-like artificial leather.

The reasons for this are its suitability because (1) ultra microfibers can be easily obtained, (2) the artificial leather can have both denseness and surface softness, and (3) it can be given an excellent surface touch; it is particularly preferred in such cases for the average denier of the island component remaining after extraction of the sea component to be 0.0001–0.2 de.

Thus, extraction of the sea component in the multicomponent filaments is necessary when islands-in-a-sea type multicomponent filaments are selected as the constituent filaments of the nonwoven fabric made of filaments, and the extraction step used can be any known method of the prior art; a polymeric elastomer such as urethane may be impregnated in the spaces after the extraction step, the island component may be extracted after impregnation of the polymeric elastomer, or it may be extracted simultaneously with impregnation of the polymeric elastomer, depending on appropriate selection, but it is preferred for the island component to be extracted simultaneously with impregnation of the polymeric elastomer in order to eliminate a step.

The nonwoven fabric made of filaments according to the invention is useful for preparation of artificial leather which has a feel and softness that has not been hitherto possible. By adjusting the softness, surface pattern, color, gloss, etc. of the resulting artificial leather it is possible to employ it for a wide variety of purposes, for example shoes such as sports shoes, various types of balls such as soccer balls, basketballs, volleyballs and the like, bags and pouches of all kinds including portfolios, handbags and briefcases, sheets such as sofa and chair covering sheets, furniture sheets, automobile sheets, etc., glove products such as golf gloves, baseball gloves, ski gloves and the like, or for clothing, wearing gloves, belts and so forth.

The present invention will now be explained in more detail by way of examples, with the understanding that the invention is in no way limited thereby.

The measured values in the examples were determined by the methods described below, and unless otherwise specified they represent the average values of five different measurements.

Limiting Viscosity

This was determined by preparing a solution of the sample and measuring at 35° C. according to a common method. The solvent used is described in the examples.

Sample Thickness

A thickness meter ("543-101F", product of Mitsuto) was used for measurement under a load of 0.98 N on a 1-cm diameter weight.

Tensile Stress, Tensile Strength and Breaking Elongation

Following the method of JIS L-1096, a sample with a width of 1 cm and a length of 9 cm was caught and held at a 5 cm spacing, and an universal tensile tester was used for elongation at a tension speed of 6 cm/min, measuring the tensile stress as the stress at 20% elongation ($\sigma 20$), and the tensile strength and breaking elongation respectively as the load value and elongation ratio at breakage.

Bending Resistance (Rb)

A 2-cm wide×9-cm long sample was prepared, the lengthwise end thereof was held with a holding apparatus, the sample was bent 90° into a U-shape, the measuring tips of a U-gauge were pressed against the ends thereof, and the load value was recorded and calculated per centimeter of width. The units are g/cm, and the bending resistance represents the softness of the fabric, with a lower value indicating greater softness.

Ratio of 20% Tensile Stress to Bending Resistance

Natural leather has properties of "softness and tight handling property" which are exhibited due to its dense and uniform structure, and (20% stress)/(bending resistance)= ($\sigma 20$/Rb) was adopted as an index thereof, taking the average value of length and width.

Compression Percentage

A 100 mm×100 mm sample was prepared and set on a level platform, and the thickness (A) at the center of the sample was measured with a load of 80 g/cm$^2$ applied. The thickness (B) at was then measured at the same position with a load of 500 g/cm$^2$ applied, and [(A−B)/A]×100 (%) was calculated.

Number of Fiber Bundles Aligned Parallel to Direction of Thickness of Nonwoven Fabric A cross-section selected parallel to the direction of thickness of the nonwoven fabric was photographed with an electron microscope at 40× magnification, and a visual count was made of the number of fiber bundles in a distance of 1 cm on a line perpendicular to the direction of thickness of the nonwoven fabric.

Percentage of Unit Area Occupied by Fiber Bundles in Cross-Section Parallel to Surface A cross-section parallel to the surface of the nonwoven fabric was photographed with an electron microscope at 50× magnification, the photograph was further enlarged to 200%, the portions of the copied paper surface corresponding to fiber bundles were cut out, their areas were measured and summed as the total area, and the percentage of area occupied by the fiber bundles was calculated as (total area of fiber bundles/area of photograph)×100(%).

Number of Cut Ends of Filaments per Unit Area of Nonwoven Fabric Surface

The surface of the nonwoven fabric was photographed with an electron microscope at 100× magnification, the number of cut ends of filaments per 0.5 mm×0.5 mm section was counted, the average of 5 sections was taken, this was calculated per area, and the number of cut ends of filaments per 1 mm$^2$ area was determined therefrom.

Splitting Percentage

The splitting percentage of splittable-type multicomponent filaments was determined by photographing the surface of the nonwoven fabric with an electron microscope at 200× magnification, measuring the cross-sectional area of 100 filaments, and dividing the difference between the total area and the cross-sectional area of the non-split filaments (including those not completely split, for example those split into about 2 or 3 parts) by the total area. A larger splitting percentage indicates better splitting.

Average Area of Spaces and Standard Deviation

The average area of spaces between the filaments in a cross-section of the nonwoven fabric and a cross-section of artificial leather was measured by the following method of image analysis with a scanning electron microscope.

(1) Sample fabrication: The cross-sectional sample of the nonwoven fabric to be measured is coated with metal by ion sputtering using a "JFC-1500" ion sputtering apparatus made by Nihon Denshi, KK. under conditions of a working pressure of 0.1 Pa or less and a coating thickness of 800 angstroms.

(2) Electron microscopy: The sample fabricated in (1) above is set in a "JSM-6100" scanning microscope made by Nihon Denshi, KK. under conditions of an accelerated voltage of 5 kV, a filament current of 2.2 A and a scanning rate of 15.7 sec/line (horizontal, 60 Hz), the image signal waveform is displayed on an CRT for observation, the maximum and minimum peak levels of the waveform are matched to 5 V and 0 V, respectively, on a potential scale, and the exposure is determined with the magnification set to 200×.

(3) Image processing: An "IP-1000PC" high precision image analyzing system manufactured by Asahi Kasei, KK. is used for measurement by selection of image processing of the "count of open cells" on an image automatically inputted from the scanning microscope. The binary number threshold for this image processing is the luminance at the center point between the maximum and minimum peak (luminance=O) levels of peak of luminance distribution obtained from the image analysis. The low portion of luminance defined by the threshold value is extracted as the space portion.

(4) Calculation of average area and standard deviation: The areas of the extracted space portions present in 0.25 $mm^2$ regions of the nonwoven fabric cross-section were measured, and the same procedure was repeated at least 3 times at different locations of the nonwoven fabric cross-section. The average area and standard deviation were calculated from the areas of the space portions obtained in this manner.

Buckling Creases

A sample of 4 cm length and width was fabricated, and the sample was held at a section 1 cm from the end of the hem part in the warp direction (or weft direction), a visual count was made of the number of buckling creases occurring on the surface when the spacing of the held portion was reduced from 2 to 1 cm with the surface bending inward, and the count was judged according to the scale listed below. A count of 7 buckling creases or fewer is adequate for practical use.

◎ 0–2 buckling creases
○ 3–7 buckling creases
× 8 or more buckling creases

Nubuck Feeling

A sample of 4 cm length and width was fabricated, and the nubuck formation face of the sample was traced with a finger to determine the state of erected pili and the feel, which were judged according to the following scale.

◎ very dense and fine erected pili with excellent feel
○ slightly rough erected pili, but with excellent feel
× rough erected pili, with normal feel

EXAMPLE 1

Fabrication of Nonwoven Fabric 1

Figure 8:
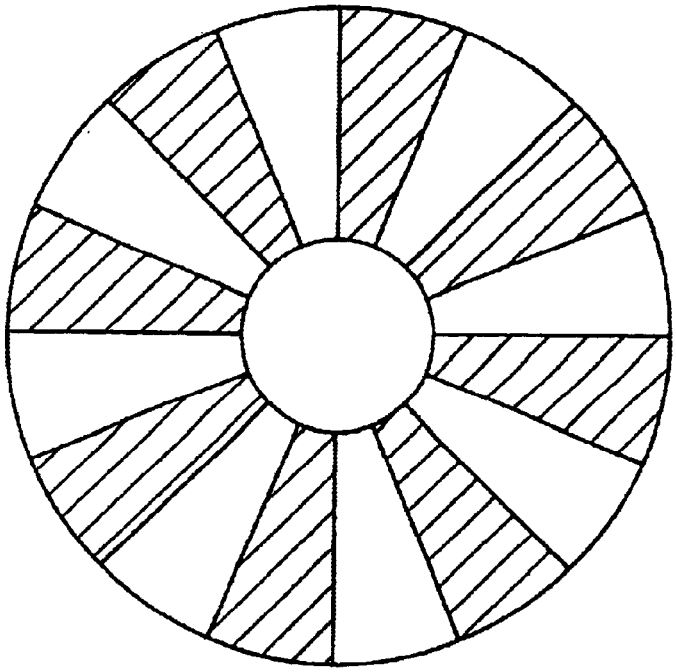
FIG. 8 is a schematic view illustrating the lateral cross-sectional shape of splittable multicomponent filaments produced in Example 1.

Polyethylene terephthalate copolymer (limiting viscosity of 0.64 in o-chlorophenol) obtained by polycondensation of an acid component containing 10 mol % of dimethyl isophthalate based on dimethyl terephthalate and a prescribed amount of ethylene glycol, as the first component, and nylon 6 (limiting viscosity of 1.1 in m-cresol) as the second component, were supplied to an extruder and separately melt kneaded, after which they were discharged from a hollow nozzle spinneret at a discharge rate per filament of 2 g/min, and after high speed drawing at an ejector pressure of 3.5 $kg/cm^2$, they were allowed to impact on a scattering board with an air stream to open the filaments, and collected on a meshed table conveyor as a nonwoven fabric made of filaments comprising splittable-type multicomponent filaments with a 16-split type multilayer laminate-type cross-section such as shown in FIG. 8. The volume ratio of the two components was 50:50, and the components were arranged alternately, with 16 layers.

Next, the nonwoven fabric made of filaments was sprayed with an oil composed mainly of a fatty acid metal salt and silicone to a coverage of 1.5 wt % based on the filament weight, and a commercially available needle (9 barbs, 0.08 mm barb depth) was used for needle punching at 800 $P/cm^2$ to a penetration depth of 8.7 mm, after which tangling treatment by high pressure water stream was carried out once at a water pressure of 50 $kg/cm^2$ and twice at 140 $kg/cm^2$ from the front side, and then twice at a water pressure of 140 $kg/cm^2$ from the back side. The filaments were partly cut during the needle punching, and no bending of the needle occurred.

After immersing the nonwoven fabric made of filaments in a warm water bath at 90° C. for 60 seconds, it was dried with a hot air drier at 110° C. to obtain nonwoven fabric 1.

EXAMPLE 2

Fabrication of Nonwoven Fabric 2

Figure 9:
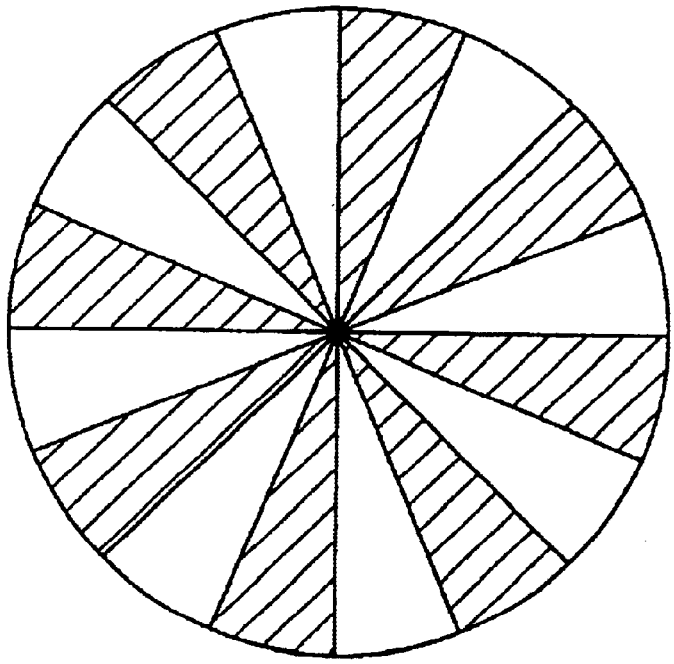
FIG. 9 is a schematic view illustrating the lateral cross-sectional shape of splittable multicomponent filaments produced in Example 2.

Nonwoven fabric 2 was obtained by the same procedure as in Example 1, except that a solid-type spinneret was used, and the filament lateral cross-section was altered to the shape shown in FIG. 9.

EXAMPLE 3

Fabrication of Nonwoven Fabric 3

Nonwoven fabric 3 was obtained by the same procedure as in Example 1, except that the needle punching was followed by immersion in an aqueous emulsion containing 10% benzyl alcohol and 2% of a nonionic surfactant for 10 minutes at room temperature and, after water washing and squeezing, shrinking treatment for 20 minutes in a warm water bath at 90° C.

COMPARATIVE EXAMPLE 1

Fabrication of Nonwoven Fabric 4

Polyethylene terephthalate (limiting viscosity of 0.63 in o-chlorophenol) as the first component and nylon 6 (limiting viscosity of 1.1 in m-cresol) as the second component were spun at a discharge rate per filament of 2 g/min, and wound up at a take-up speed of 1000 m/min by a common melt spinning method, to obtain splittable-type multicomponent undrawn filaments of 6.6. de with the filament lateral cross-section shape shown in FIG. 10. The undrawn filaments were then drawn 2.0-fold in warm water at 40° C., to obtain 3.3 de drawn filaments. They were then coated with an oil to 0.3 wt % based on the filament weight, and passed through a stuffing box for mechanical crimping, dried in a conveyer-type hot air drier at 60° C. and cut to 45 mm to obtain splittable-type multicomponent staple fibers containing a thermal shrinking component.

The splittable-type multicomponent staple fibers were opened with a parallel carding machine, and the resulting nonwoven fabric made of staple fibers was layered with a crosslapper and the same type of needle in Example 1 was used for needle punching at 400 $P/cm^2$ to a penetration depth of 8.7 mm, after which tangling treatment by high pressure water stream was carried out once at a water pressure of 50 kg/cm$^2$ and twice at 140 kg/cm$^2$ from the front side, and then twice at a water pressure of 140 kg/cm$^2$ from the back side, to prepare a nonwoven fabric made of staple fibers. The percentage of splitting among the splittable-type multicomponent staple fibers composing the nonwoven fabric was 95%.

After immersing the nonwoven fabric in a warm water bath at 75° C. for 20 seconds, the surface was subjected to 19% shrinkage and dried with a hot air drier at 320° C. to obtain nonwoven fabric 4 having an average denier of 0.21 de.

COMPARATIVE EXAMPLE 2a

Fabrication of Nonwoven Fabric 5a

Nonwoven fabric 5a was obtained by the same procedure as in Example 3, except that a needle with 9 barbs and a barb depth of 0.03 mm was used for needle punching at 280 P/cm$^2$ to a penetration depth of 6.4 mm. Virtually no cut ends were found in the resulting nonwoven fabric.

COMPARATIVE EXAMPLE 2b

Fabrication of Nonwoven Fabric 5b

Nonwoven fabric 5b was obtained by the same procedure as in Example 3, except that the oil used was an oil composed mainly of paraffin-based wax.

COMPARATIVE EXAMPLE 3

Fabrication of Nonwoven Fabric 6

Polyethylene terephthalate copolymer (limiting viscosity of 0.64 in o-chlorophenol) obtained by polycondensation of an acid component containing 10 mol % of dimethyl isophthalate in terms of dimethyl phthalate and a prescribed amount of ethylene glycol was used for spinning and drawing to obtain drawn filaments with a denier of 2 de. These were then coated with an oil to 0.3 wt % based on the filament weight, and passed through a stuffing box for mechanical crimping, dried in a conveyer-type hot air feedthrough drier at 60° C. and cut to 51 mm to obtain thermal shrinking staple fibers. In the same manner, polyethylene terephthalate (limiting viscosity of 0.63 in o-chlorophenol) was used to obtain staple fibers with a denier of 2 de, cut to 51 mm length.

The staple fibers were then blended at a blending ratio of 30 wt % based on the total staple fiber weight of the thermal shrinking staple fibers, the nonwoven fabric made of carded staple fibers opened with a parallel carding machine was layered with a crosslapper, and a commercially available needle (9 barbs, 0.08 mm barb depth) was used for needle punching at 1500 P/cm$^2$ to a penetration depth of 8.7 mm, followed by thermal shrinking treatment in warm water at 80° C. to obtain nonwoven fabric 6.

EXAMPLE 4

Fabrication of Nonwoven Fabric 7

Nylon 6 (limiting viscosity of 1.34 in m-cresol) as the island component and polyethylene (melt flow rate: 50) as the sea component were mixed with a chip at a weight ratio of 50:50 and melted with an extruder, after which the mixture was discharged from a nozzle with circular openings at a discharge rate of 1.3 g/min per single opening and subjected to high-speed drawing at an ejector pressure of 2.5 kg/cm$^2$, and they were then allowed to impact on a scattering board with an air stream to open the filaments, and collected on a meshed table conveyor as a nonwoven fabric made of filaments comprising islands-in-a-sea type multicomponent filaments. The denier of the filaments was 3.8 de. Next, the nonwoven fabric made of filaments was sprayed with an oil composed mainly of a fatty acid metal salt and silicone to a coverage of 2 wt % based on the filament weight, and a commercially available needle (9 barbs, 0.08 mm barb depth) was used for needle punching at 600 P/cm$^2$ to a penetration depth of 8.7 mm, to obtain nonwoven fabric 7.

EXAMPLE 5

Fabrication of Nonwoven Fabric 8

Polyethylene terephthalate (limiting viscosity of 0.64 in o-chlorophenol) as the island component and polyethylene (melt flow rate: 50) as the sea component were melted separately with extruders, and discharged at a weight ratio of 70:30 from an islands-in-a-sea multicomponent-type nozzle with 19 islands and circular openings at a discharge rate of 1.3 g/min per single opening and subjected to high-speed drawing at an ejector pressure of 2.5 kg/cm$^2$, after which they were allowed to impact on a scattering board with an air stream to open the filaments, and collected on a meshed table conveyor as a nonwoven fabric made of filaments comprising islands-in-a-sea type multicomponent filaments. The denier of the filaments was 2.8 de. Next, the nonwoven fabric made of filaments was sprayed with an oil to a coverage of 2 wt % based on the filament weight, and a commercially available needle (9 barbs, 0.08 mm barb depth) was used for needle punching at 600 P/cm$^2$ to a penetration depth of 8.7 mm, to obtain nonwoven fabric 8.

COMPARATIVE EXAMPLE 4

Fabrication of Nonwoven Fabric 9

Nylon 6 (limiting viscosity of 1.34 in m-cresol) as the island component and polyethylene (melt flow rate: 50) as the sea component were mixed with a chip at a weight ratio of 50:50, and wound up at a take-up speed of 1000 m/min by a common melt spinning method, followed by drawing to obtain drawn filaments of 8 de with the same filament lateral cross-sectional shape as the filaments obtained in Example 5. These were then coated with an oil to 0.3 wt % based on the filament weight, and passed through a stuffing box for mechanical crimping, dried in a conveyer-type hot air drier at 60° C. and cut to 45 mm to obtain islands-in-a-sea type multicomponent staple fibers.

The islands-in-a-sea type multicomponent staple fibers were opened with a parallel carding machine, the resulting nonwoven fabric made of carded staple fibers was layered with a crosslapper, and a commercially available needle (1 barb, 0.08 mm barb depth) was used for needle punching at 2000 P/cm$^2$ to a penetration depth of 8.7 mm to obtain nonwoven fabric 9.

EXAMPLE 6

Fabrication of Nonwoven Fabric 10

Polyethylene terephthalate copolymer (limiting viscosity of 0.64 in o-chlorophenol) obtained by polycondensation of an acid component containing 10 mol % of dimethyl isophthalate based on dimethyl terephthalate and a prescribed amount of ethylene glycol, was supplied to an extruder for melt kneading, after which it was discharged from a nozzle with circular cross-section openings at a discharge rate per filament of 1.1 g/min, and after high speed drawing at an ejector pressure of 3.5 kg/cm$^2$, it was allowed to impact on a scattering board with an air stream to open the filaments, and collected on a meshed table conveyor as a nonwoven fabric made of filaments with a denier of 2 de. Next, the nonwoven fabric made of filaments was sprayed with an oil composed mainly of a fatty acid metal salt and silicone to a coverage of 1.5 wt % based on the filament weight, and a commercially available needle (9 barbs, 0.08 mm barb depth) was used for needle punching at 800 P/cm$^2$ to a penetration depth of 8.7 mm, after which it was immersed for 60 seconds in a warm water bath at 90° C. and then dried with a hot air drier at 110° C. to obtain nonwoven fabric 10.

The properties of the nonwoven fabrics obtained above are listed in Table 1.

TABLE 1

| | Example 1 | Example 2 | Example 3 | Comp.Ex.1 | Comp.Ex.2a | Comp.Ex.2b |
|---|---|---|---|---|---|---|
| Nonwoven fabric No. | 1 | 2 | 3 | 4 | 5a | 5b |
| Cross-section shape | hollow | hollow | hollow | hollow | hollow | hollow |
| Denier before splitting (de) | 3.7 | 3.9 | 3.7 | 3.3 | 3.7 | 3.7 |
| Number of fiber bundles (n/cm) | 14 | 16 | 18 | 9 | 12 | 4 |
| Area occupied by fiber bundles (%) | 9.0 | 10.5 | 12.2 | 4.2 | 8.5 | 2.3 |
| Number of surface filament cut ends (n/mm$^2$) | 24 | 18 | 20 | 136 | 1≦ | 1≦ |
| 20% stress (kg/cm) (MD/CD) | 2.8/2.6 | 2.9/2.7 | 2.8/2.6 | 3.7/1.9 | 2.4/2.3 | 1.8/1.7 |
| σ20/Rb | 15.2 | 17.6 | 9.0 | 6.7 | 6.9 | 6.0 |
| Compression percentage (%) | 13.4 | 13.5 | 12.4 | 9.8 | 10.3 | 12.3 |
| Area shrinkage (%) | 12 | 9 | 14 | 19 | 16 | 15 |
| Splitting percentage (%) | 95 | 91 | 97 | 95 | 97 | 97 |
| Thickness (mm) | 1.32 | 1.33 | 1.32 | 1.29 | 1.33 | 1.33 |
| Apparent density (g/cm$^3$) | 0.31 | 0.30 | 0.31 | 0.30 | 0.32 | 0.32 |
| Denier after splitting (de) | 0.23 | 0.24 | 0.23 | 0.21 | 0.23 | 0.23 |
| Average area of space (μm$^2$) | 204.9 | 220.5 | 258.4 | 266.8 | 246.2 | 278.8 |
| Standard deviation of space area (μm$^2$) | 420.6 | 421.3 | 432.8 | 489.5 | 419.3 | 443.9 |

| | Comp.Ex.3 | Example 4 | Example 5 | Comp.Ex.4 | Example 6 |
|---|---|---|---|---|---|
| Nonwoven fabric No. | 6 | 7 | 8 | 9 | 10 |
| Cross-section shape | solid | solid | solid | solid | solid |
| Denier before splitting (de) | 2 | 3.8 | 2.8 | 8 | 2 |
| Number of fiber bundles (n/cm) | 1 | 6 | 8 | 0.5 | 12 |
| Area occupied by fiber bundles (%) | 1.9 | 12.2 | 10.3 | 2.1 | 10.3 |
| Number of surface filament cut ends (n/mm$^2$) | 54 | 6 | 7 | 22 | 12 |
| 20% stress (kg/cm) (MD/CD) | 2.3/1.1 | 1.9/1.2 | 1.8/1.5 | 0.5/0.3 | 2.7/2.2 |
| σ20/Rb | 4.3 | 5.5 | 5.1 | 1.2 | 6.9 |
| Compression percentage (%) | 6.4 | 16.4 | 15.5 | 32.3 | 11.1 |
| Area shrinkage (%) | 25 | — | — | — | 23 |
| Splitting percentage (%) | — | — | — | — | — |
| Thickness (mm) | 1.31 | 1.35 | 1.32 | 2.9 | 1.45 |
| Apparent density (g/cm$^3$) | 0.31 | 0.27 | 0.26 | 0.17 | 0.29 |
| Denier after splitting (de) | (2) | — | — | — | — |
| Average area of space (μm$^2$) | 820.5 | — | — | — | — |
| Standard deviation of space area (μm$^2$) | 1560.3 | — | — | — | — |

The results shown in Table 1 will now be discussed. Examples 1–3 satisfy all of the conditions of the present invention, and the cross-sections of the resulting nonwoven fabrics showed dense and uniform structures. In particular, the nonwoven fabric obtained in Example 1, which was composed of splittable-type multicomponent filaments wherein the constituent filaments had a hollow lateral cross-sectional shape, had filaments in a rough aggregated state, which upon shrinkage exhibited a very uniform and dense structure.

On the other hand, the nonwoven fabrics obtained by the procedures of Comparative Example 1 and 3 which were composed of staple fibers had apparent density and average area of space comparable to the nonwoven fabrics made of filaments obtained by the procedures in the examples, but because these nonwoven fabrics were made of staple fibers the number of cut ends of fibers on the surface of the nonwoven fabrics exceeded 100 per mm$^2$, and it was not possible to obtain nonwoven fabrics with sufficient softness and suitable bending resistance which are the object of the invention.

In Comparative Example 2a, however, the number of cut ends of filaments on the nonwoven fabric surface was less than 5 per mm$^2$, so that it was not possible to obtain nonwoven fabrics with sufficient softness and suitable bending resistance which are the object of the invention. The oil was changed in Comparative Example 2b, but fiber bundles were not adequately formed, the 20% stress was reduced, the bending resistance was greater than in Comparative Example 2a, and the fabric did not have adequate softness.

Examples 4 and 5 were nonwoven fabrics made of filaments wherein the constituent filaments were islands-in-a-sea type multicomponent filaments, and Comparative Example 4 was a nonwoven fabric made of staple fibers wherein the constituent filaments were islands-in-a-sea type multicomponent filaments. Examples 4 and 5 satisfied all of the conditions for a nonwoven fabric of the invention, and had excellent limited stretching and a full handle. In contrast, the nonwoven fabric of Comparative Example 4 had less than 5 fiber bundles per centimeter, and despite being soft had no tight handling property.

Example 6 was a nonwoven fabric made of filaments wherein the constituent filaments were filaments with a denier of 2.0 de, and it was an excellent nonwoven fabric made of filaments from the standpoint of softness and a tight feeling.

EXAMPLES 7–10, COMPARATIVE EXAMPLES 5–7

Fabrication of Full-Grain Artificial Leathers 1–7

Nonwoven fabrics 1–6 and 10 fabricated in Examples 1–3, Example 6 and Comparative Examples 1–3 were each immersed in a 1.4% aqueous emulsion of dimethylsiloxane to a pick-up of 180% (nonwoven fabric weight after impregnation of 180 wt % based on the nonwoven fabric weight before impregnation), and were dried at 100° C. for 30 minutes.

Following this, diphenylmethane diisocyanate, polytetramethylene glycol, polyoxyethylene glycol, polybutylene adipate diol and trimethylene glycol were used according to a common method to synthesize polyurethane with a 100% elongation stress of 110 kg/cm$^3$, and the fabrics were impregnated with a W/o type emulsion prepared by dispersing water at a proportion of 35 parts by weight to 100 parts by weight of a methyl ethyl ketone slurry containing 16 wt % of the aforementioned polyurethane based on the total slurry weight, the excess emulsion on the surface was wiped off, and they were then coagulated and dried in an atmosphere at a temperature of 45° C., 70% relative humidity. Also, a 50 $\mu$m-thick polyurethane coating formed on a release sheet was attached using a two-part urethane-based adhesive, and after adequate drying and crosslinking reaction the release sheet was peeled off to obtain the full-grain artificial leathers 1–7.

The properties of the artificial leathers obtained in Examples 7–10 and Comparative Examples 5–7 are listed in Table 2.

Also listed are the properties of natural kangaroo leather (Reference Example 1), and the properties of artificial leather comprising islands-in-a-sea type multicomponent staple fibers of nylon 6/polyethylene terephthalate, a commercially available artificial leather (Reference Example 2).

because of the low number of fiber bundles of the nonwoven fabrics made of staple fibers used as the base fabrics, they had softness but inadequate bending resistance, and also exhibited low intralayer adhesion strength.

Comparative Example 6a had few cut ends of filaments on the surface of the nonwoven fabric made of filaments used as the base fabric, and the leather therefore had high bending resistance and lacked softness. Comparative Example 6b had few fiber bundles, and while the bending resistance was higher, it also lacked a uniformly tangled state and had a large number of buckling creases.

The artificial leather obtained in Comparative Example 7 and the artificial leather of Reference Example 2, which had particularly rough structures, had a tight handling property, but upon bending of the surface inward innumerable buckling creases were found.

EXAMPLES 11–2, COMPARATIVE EXAMPLE 8

Fabrication of Nubuck-Like Artificial Leathers 1–3

The nonwoven fabrics 7–9 fabricated in Examples 4 and 5 and Comparative Example 4 were each immersed in a 1.4% aqueous emulsion of dimethylsiloxane to a pick-up of 180% (nonwoven fabric weight after impregnation of 180 wt % based on the nonwoven fabric weight before impregnation), and were dried at 70° C. for 30 minutes.

TABLE 2

| | Example 7 | Example 8 | Example 9 | Comp. Ex. 5 | Comp. Ex. 6a | Comp. Ex. 6b | Comp. Ex. 7 | Ref. Ex. 1 | Ref. Ex. 2 | Example 10 |
|---|---|---|---|---|---|---|---|---|---|---|
| Full-grain artificial leather No. | 1 | 2 | 3 | 5 | 6a | 6b | 7 | — | — | 4 |
| Nonwoven fabric used | 1 | 2 | 3 | 4 | 5a | 5b | 6 | — | — | 10 |
| Nonwoven fabric:resin (ratio) | 77:35 | 77:35 | 77:35 | 77:35 | 77:35 | 77:35 | 77:35 | — | — | 77:35 |
| Thickness (mm) | 1.62 | 1.58 | 1.61 | 1.52 | 1.59 | 1.58 | 1.57 | 0.75 | 1.53 | 1.69 |
| Apparent density (g/cm$^3$) | 0.44 | 0.42 | 0.44 | 0.44 | 0.44 | 0.44 | 0.46 | 0.64 | 0.44 | 0.42 |
| Number of fiber bundles (n/cm) | 17 | 18 | 18 | 7 | 13 | 5 | 1 | — | 8 | 14 |
| Area occupied by fiber bundles (%) | 22.0 | 26.3 | 28.9 | 8.7 | 21.2 | 2.5 | 2.9 | — | 3.8 | 22.2 |
| Tensile strength (kg/cm) (MD/CD) | 20.1/16.8 | 25.5/22.1 | 23.5/20.6 | 24.2/17.3 | 20.1/18.9 | 15.1/12.2 | 18.1/14.7 | 34.5/32.5 | 16.2/18.0 | 20.2/19.3 |
| Breaking elongation (%) (MD/CD) | 134/111 | 140/148 | 142/148 | 105/144 | 145/149 | 122/115 | 121/151 | 79/78 | 75/113 | 142/137 |
| 20% stress (kg/cm) (MD/CD) | 3.6/3.6 | 3.5/3.2 | 4.8/3.0 | 6.1/1.8 | 3.9/2.1 | 2.2/1.9 | 4.6/3.4 | 4.3/3.5 | 4.3/2.6 | 3.4/3.2 |
| $\sigma$20/Rb | 4.5 | 5.6 | 5.6 | 6.5 | 2.6 | 2.2 | 1.0 | 13.0 | 2.7 | 4.1 |
| Intralayer adhesion strength (kg/cm) | 5.3 | 6.2 | 7.8 | 2.5 | 7.9 | 2.8 | 7.0 | 5.2 | 7.3 | 5.8 |
| Average area of space ($\mu$m$^2$) | 98.5 | 103.4 | 111.3 | 145.9 | 138.3 | 150.2 | 292.1 | — | 368.1 | — |
| Standard deviation of space area ($\mu$m$^2$) | 140.3 | 150.1 | 136.1 | 221.4 | 159.2 | 223.2 | 565.2 | — | 918.8 | — |
| Buckling creases | ⊚ | ○ | ○ | X | ○ | X | ○ | ○ | X | ○ |

The results shown in Table 2 will now be discussed. The artificial leathers obtained by the procedures of Examples 7–9 according to the invention satisfy all of the conditions, and the cross-sections of the resulting artificial leathers had dense and uniform structures. Because of their dense and uniform structures, there was also no anisotropy of 20% stress in the warp and weft directions, the limited stretching feel was exhibited, and the leathers were soft with a tight handling property. The artificial leathers also had an excellent appearance with no buckling creases upon bending. The artificial leather of Example 10 employing a nonwoven fabric made of non-splittable filaments also satisfied all of the conditions, and had both softness and a tight handling property which cannot be obtained with leather composed of conventional nonwoven fabric made of staple fibers.

On the other hand, Comparative Examples 5 and 7 had apparent density equivalent to that of the examples but Following this, diphenylmethane diisocyanate, polytetramethylene glycol, ethylene glycol and polybutylene adipate diol were reacted according to a common method to obtain polyurethane with a nitrogen content of 4.5% based on isocyanate which was then dissolved in a dimethylformamide solution to prepare a dimethylformamide (DMF) solution of polyurethane (15 wt % concentration), and the nonwoven fabrics 7–9 were each impregnated with the solution and further immersed in a 15 wt % aqueous DMF solution for coagulation. After adequate washing in warm water at 40° C., they were dried in a hot air chamber at 135° C. to obtain urethane-impregnated substrates.

The substrates were subjected to repeated dipping in toluene at 80° C. and nipping, and the polyurethane component of the filament constituent components was removed by dissolution to generate fine denier filaments from the islands-in-a-sea type multicomponent filaments. The toluene in the substrate was then removed by azeotropic distillation in hot water at 90° C., and drying in a hot air chamber at 120° C. followed by light buffing 4 times with 600 mesh sandpaper yielded nubuck-like artificial leathers 1–3.

The properties of the nubuck-like artificial leathers obtained by the procedures of Examples 11 and 12 and Comparative Example 8 are listed in Table 3.

Also listed are the properties of artificial leather wherein the substrate was a nonwoven fabric comprising islands-in-a-sea type multicomponent staple fibers of nylon 6/polyethylene, a commercially available artificial leather, as Reference Example 3.

TABLE 3

| | Example 11 | Example 12 | Comp. Ex. 8 | Ref. Ex. 3 |
|---|---|---|---|---|
| Nubuck-like artificial leather No. | 1 | 2 | 3 | — |
| Nonwoven fabric used | 7 | 8 | 9 | — |
| Nonwoven fabric: resin (ratio) | 77:38 | 77:38 | 77:38 | — |
| Thickness (mm) | 0.85 | 0.82 | 0.95 | 0.39 |
| Apparent density ($g/cm^3$) | 0.37 | 0.36 | 0.36 | 0.41 |
| Number of fiber bundles (n/cm) | 5 | 7 | 0.5 | 1 |
| Area occupied by fiber bundles (%) | 15.6 | 18.9 | 3.4 | 1.8 |
| Tensile strength (kg/cm) (MD/CD) | 15.7/10.2 | 14.3/10.0 | 13.1/12.2 | 21.9/20.61 |
| Breaking elongation (%) (MD/CD) | 123/123 | 130/128 | 158/164 | 75/115 |
| 20% stress (kg/cm) (MD/CD) | 2.6/1.7 | 2.4/1.6 | 0.8/0.4 | 6.0/2.3 |
| σ20/Rb | 10.8 | 9.5 | 1.0 | 2.0 |
| Intralayer adhesion strength (kg/cm) | 3.1 | 3.1 | 3.2 | 2.8 |
| Nubuck feel | ⊚ | ○ | X | X |

The results shown in Table 3 will now be discussed. The artificial leathers obtained by the procedures of Examples 11 and 12 had uniform and dense structures and a large number of fiber bundles, and therefore exhibited suitable softness and a tight handling property as also represented by the σ20/Rb values, while the surfaces also had a very satisfactory nubuck-like feel.

On the other hand, the artificial leather obtained by the procedure of Comparative Example 8, which had only one fiber bundle per centimeter, lacked a limited stretching feel and also had no tight handling property. The artificial leather of Reference Example 3 had a tight handling property but lacked softness, giving it a different feel from natural leather, while the nubuck feel of the surface was also inferior.

EXAMPLE 12

The artificial leather obtained by the procedure of Example 7 was used as an upper material for a shoes in a two-month wearing test. Due to the softness of the artificial leather, the manufactured shoes fit well onto the feet, the wear comfort was satisfactory, and absolutely no problems of durability were found upon completion of the test.

What is claimed is:

1. An artificial leather comprising (i) a nonwoven fabric made of filaments, which comprises filaments formed from a fiber-forming thermoplastic polymer and which satisfies all of the following conditions (A) to (D);

(A) fiber bundles are present in a range of 5–70 per centimeter in any cross-section parallel to the direction of thickness of the nonwoven fabric;

(B) the total area occupied by the fiber bundles is in a range of 5–70% of the cross-sectional area of any cross-section perpendicular to the direction of thickness of the nonwoven fabric;

(C) The apparent density is 0.10–0.50 $g/cm^3$; and (D) cut ends of the fibers on the nonwoven fabric surface are present in a range of 5–100 per $mm^2$ of surface area;

wherein the filaments are fine denier filaments which are obtained from splittable multicomponent filaments comprising a polymer with two or more components, and satisfy all of the following conditions (E), (G), (H):

(E) the denier of the filaments is 0.01–0.5 de;

(G) the average area of space in any cross-section of the nonwoven fabric is 70–300 $\mu m^2$ as measured by a method of image analysis with a scanning electron microscope; and (H) the structure has uniformity represented by a standard deviation of space area in any cross-section of the nonwoven fabric of 200–450 $\mu m^2$ as measured by a method of image analysis with a scanning electron microscope;

and (ii) a polymeric elastomer impregnated therein, which artificial leather satisfies all of the following conditions (I) to (N):

(I) the fiber bundles are present in a range of 5–70 per centimeter of width in any cross-section parallel to the direction of thickness of the artificial leather;

(J) the total area occupied by the fiber bundles is in a range of 5–70% of the cross-sectional area of any cross-section perpendicular to the direction of thickness of the artificial leather;

(K) At least a portion of the impregnated polymeric elastomer is polymeric elastomer which is not fixed among the fibers;

(L) the tensile stress at 20% elongation (σ20) in the warp direction and the tensile stress at 20% elongation (σ20) in the weft direction of the artificial leather are each in the range of 1.5–10 kg/cm;

(M) the ratio of the 20% elongation (σ20) in the warp direction to the bending resistance (Rb (g/cm)) for the artificial leather and the ratio of the 20% elongation (σ20) in the weft direction to the bending resistance (Rb (g/cm)) for the artificial leather have an average value of 3–30; and (N) the apparent density of the artificial leather is 0.20–0.60 $g/cm^3$;

and wherein tahe artificial leather satisfies all of the following conditions (O) to (Q):

(O) the fiber bundles are present in a range of 10–50 per centimeter in any cross-section parallel to the direction of thickness of the artificial leather;

(P) the average area of space in any cross-section of the artificial leather is 70–140 $\mu m^2$ as measured by a method of image analysis with a scanning electron microscope; and (Q) the structure has uniformity represented by a standard deviation of space area in any cross-section of the artificial leather of 80–200 $\mu m^2$ as measured by a method of image analysis with a scanning electron microscope.

* * * * *